US009963763B2

(12) United States Patent
Demetriou et al.

(10) Patent No.: US 9,963,763 B2
(45) Date of Patent: May 8, 2018

(54) PRODUCTION OF METALLIC GLASS BY MELT DEPOSITION

(71) Applicant: Glassimetal Technology, Inc., Pasadena, CA (US)

(72) Inventors: Marios D. Demetriou, West Hollywood, CA (US); Joseph P. Schramm, Sierra Madre, CA (US); William L. Johnson, San Marino, CA (US); David S. Lee, Wenham, MA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 745 days.

(21) Appl. No.: 14/503,245

(22) Filed: Sep. 30, 2014

(65) Prior Publication Data

US 2015/0090371 A1 Apr. 2, 2015

Related U.S. Application Data

(60) Provisional application No. 61/884,653, filed on Sep. 30, 2013, provisional application No. 61/924,365, filed on Jan. 7, 2014.

(51) Int. Cl.
*C22C 1/00* (2006.01)
*B22D 25/06* (2006.01)
(Continued)

(52) U.S. Cl.
CPC ..... *C22C 1/002* (2013.01); *B22D 11/006* (2013.01); *B22D 11/0631* (2013.01);
(Continued)

(58) Field of Classification Search
CPC .... B22D 11/006; B22D 11/0631; C22C 1/002
(Continued)

(56) References Cited

U.S. PATENT DOCUMENTS 4,290,476 A 9/1981 Smith
8,052,923 B2 11/2011 Langlet
(Continued)

FOREIGN PATENT DOCUMENTS

JP 60-137552 7/1985
JP 60137552 A * 7/1985 ..... B22D 11/006
(Continued)

OTHER PUBLICATIONS

M.D. Demetriou et al., "A damage-tolerant glass," Nature Materials, 2011 vol. 10, pp. 123-128.
(Continued)

*Primary Examiner* — Weiping Zhu
(74) *Attorney, Agent, or Firm* — Polsinelli PC

(57) ABSTRACT

Methods and apparatus for forming high aspect ratio metallic glass, including metallic glass sheet and tube, by a melt deposition process are provided. In some methods and apparatus a molten alloy is deposited inside a tubular channel formed by two concentrically arranged substrates, and shaped and quenched by conduction to the substrates in a manner that enables the molten alloy to vitrify prior to undergoing substantial shear flow. The deposition method allows the molten alloy to be deposited and formed while being quenched, without undergoing substantial shear flow.

9 Claims, 17 Drawing Sheets

(51) Int. Cl.
*B22D 27/04* (2006.01)
*B22D 11/00* (2006.01)
*B22D 11/06* (2006.01)

(52) U.S. Cl.
CPC ..... *B22D 11/0642* (2013.01); *B22D 25/06* (2013.01); *B22D 27/04* (2013.01)

(58) Field of Classification Search
USPC ..... 148/561
See application file for complete search history.

(56) References Cited

U.S. PATENT DOCUMENTS

| | | | |
|---|---|---|---|
| 8,485,245 | B1 | 7/2013 | Prest et al. |
| 2003/0183310 | A1 | 10/2003 | McRae |
| 2013/0306198 | A1 | 11/2013 | Prest et al. |
| 2013/0309121 | A1 | 11/2013 | Prest et al. |
| 2014/0202595 | A1 | 6/2014 | Hofmann |
| 2016/0023438 | A1 | 1/2016 | Johnson et al. |

FOREIGN PATENT DOCUMENTS

| | | |
|---|---|---|
| JP | 62-183944 | 8/1987 |
| JP | H04 198436 | 7/1992 |
| WO | WO 2013/089651 | 6/2013 |

OTHER PUBLICATIONS

S. Pauly et al., "Processing Metallic Glasses by Selective Laser Melting," Materials Today, vol. 16, pp. 37-41 (2013).

Y.J. Kim et al., "Experimental determination of the time-temperature-transformation diagram of the undercooled liquid Zr41.2Ti13.8Cu12.5Ni10Be22.5 alloy using containerless electrostatic levitation processing", Appl. Phys. Lett., 68, 1057-1059 (1996).

S. Pogatscher et al., "In-Situ Probing of Metallic Glass Formation and Crystallization upon Heating and Cooling via Fast Differential Scanning Calorimetry", Appl. Phys. Lett. 104, 251908 (2014).

V.K. Balla et al., "Laser Processing of Fe-based Bulk Amorphous Alloy", Surface & Coatings Technology, 205, 2661-2667 (2010).

G. Yang et al., "Laser Solid Forming of Zr-Based Bulk Metallic Glass," Intermetallics 22, 110-115 (2012).

J.-Y. Suh et al., Novel Thermoplastic Bonding Using a Metallic Glass Solder, Scripta Materialia 59, 905-908 (2008).

J.G. Wang et al., "Diffusion Bonding of a Zr-based Metallic Glass in its Supercooled Liquid Region", Intermetallics 46, 236-242 (2014).

J. Schroer et al., "Pronounced asymmetry in the crystallization behavior during constant heating and cooling of a bulk metallic glass-forming liquid", Phys. Rev. B. 60, 11855 (1999).

F. Incropera and D.P DeWitt, "Fundamentals of heat and Mass Transfer", 3rd Edition, 1990, p. 262.

Pond et al., "A Method of Producing Rapidly Solidified Filamentary Castings," *Transactions of the Metallurgical Society of AIME*, 1969, vol. 245, No. 11, pp. 2475.

Chen et al., "A Rapid Quenching Technique for the Preparation of Thin Uniform Films of Amorphous Solids," *Review of Scientific Instruments*, 1970, vol. 41, No. 8, pp. 1237-1238.

S. Ding et al., "Wetting of Metallic Glass Forming Liquids on Metals and Ceramics," Journal of Applied Physics, vol. 245, Issue 110, 043508 (2011).

U.S. Appl. No. 15/085,614, filed Mar. 30, 2016, Demetriou et al.

* cited by examiner

PRODUCTION OF METALLIC GLASS BY MELT DEPOSITION

CROSS REFERENCE

The present application claims the benefit under 35 U.S.C. § 119(e) of U.S. Provisional Patent Application No. 61/884,653, entitled "Production of Metallic Glass Sheet by Melt Deposition" filed on Sep. 30, 2013 and U.S. Provisional Patent Application No. 61/924,365, entitled "Production of Metallic Glass Tube by Melt Deposition", filed on Jan. 7, 2014, both of which are incorporated herein by reference in their entirety.

FIELD

The present disclosure is directed to a method of producing metallic glass objects by a melt deposition method, and apparatus for performing such melt deposition forming methodologies.

BACKGROUND

Several conventional methods for producing metallic glass sheet exist. Most of these conventional methods achieve vitrification of the formed sheet by quenching an alloy melt from a high temperature while simultaneously forming the melt into the sheet shape. One conventional method is melt spinning (also known as planar flow casting), in which the melt is injected on a thermally conducting wheel rotating at high speed (see, for example, R. Pond and R. Maddin, Transactions of the Metallurgical Society of AIME, Volume: 245, Issue: 11, Page: 2475, 1976). Another conventional method is twin-roll sheet forming, in which the melt is poured into the gap between a set of rotating thermally-conducting rollers (see, for example, H. S. Chen and Miller C. E. Miller, Review of Scientific Instruments, Volume: 41, Issue: 8, Pages: 1237-1238, 1970). Other less common methods include a float-glass method, in which the melt is poured over another heavier and more conductive melt (see, for example, US 2003/0183310 and U.S. Pat. No. 8,485,245).

There is a need for a method that achieves metallic glass objects, such as sheets or tubes with improved thickness uniformity, reduced surface defects, and are free from any crystallinity.

SUMMARY

The present disclosure is directed to methods and apparatus for forming metallic glass by a melt deposition process. In many embodiments, methods and apparatus are provided to forming metallic glass objects. In some embodiments the methods and apparatus provided are directed to forming metallic glass sheets in accordance with a melt depositions process. In other embodiments methods and apparatus are provided for forming metallic glass tubes by a melt deposition process.

In some embodiments, an apparatus is provided for forming a high aspect ratio metallic glass.

In many embodiments the apparatus includes a first substrate and a second substrate, where the first and second substrates are separated from each other by a gap of thickness t, and where the first substrate and the second substrate are configured to move relative to each other at a velocity V.

In many other embodiments the substrates and the gap are configured to form a channel having thickness t and width w defined by an overlapping cross section of the substrates perpendicular to V. In some embodiments, a molten alloy, capable of forming the high aspect ratio metallic glass sheet can be extracted along the overlapping cross section and deposited into the channel.

In some embodiments, melt is extracted from a melt reservoir through a nozzle.

In still many other embodiments, at least one of the first and second substrates cools the molten alloy rapidly.

In yet many other embodiments, the molten alloy may be deposited at a deposition rate Q that is does not vary more than 20% of a product (V*t*w). In some embodiments, the deposition rate Q does not vary more than 10% of a product (V*t*w). In still other embodiments, the deposition rate Q does not vary more than 5% of a product (V*t*w).

In still yet many other embodiments, the first and second substrates are at a temperature below the glass-transition temperature of the metallic glass In some embodiments, a method is provided for forming a metallic glass sheet.

In many embodiments the method includes depositing a molten alloy capable of forming the metallic glass sheet at a deposition rate Q in a gap of thickness t separating two substrates that have plate-like geometry.

In many other embodiments, the substrates are configured to move relatively to each other at a velocity V, and the molten alloy is extracted along an overlapping cross section having width w that is perpendicular to V. In some embodiments, the molten alloy is extracted from a melt reservoir through a nozzle.

In still many other embodiments, the molten alloy is shaped and quenched by thermal conduction to at least one of the substrates in a manner that enables the melt to vitrify, i.e. to transform to the metallic glass phase, prior to undergoing shear flow.

In some embodiments, methods and apparatus for forming metallic glass tube by a melt deposition process are provided.

In many other embodiments, a molten alloy is deposited at a deposition rate Q inside a channel of thickness t formed by two substrates having tubular geometry. In some such embodiments, the substrates are configured to move relatively to each other at a velocity V.

In other embodiments, the apparatus includes an interior tubular substrate and an exterior tubular substrate, where the interior and exterior substrates are arranged concentrically such that they are separated from each other by a gap of thickness t, and where the interior tubular substrate and the exterior tubular substrate are configured to move relative to each other at a velocity V. In some embodiments, a melt reservoir can be configured to be in fluid communication with the gap.

In still many other embodiments, the molten alloy is shaped and quenched by thermal conduction to at least one of the substrates in a manner that enables the melt to vitrify, i.e. to transform to the metallic glass phase, prior to undergoing shear flow.

In many embodiments, the apparatus and method allows a melt of metallic glass to be deposited and formed while being quenched, without undergoing shear flow.

Additional embodiments and features are set forth in part in the description that follows, and in part will become apparent to those skilled in the art upon examination of the specification or may be learned by the practice of the disclosure. A further understanding of the nature and advantages of the present disclosure may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

DETAILED DESCRIPTION

Figure 1:
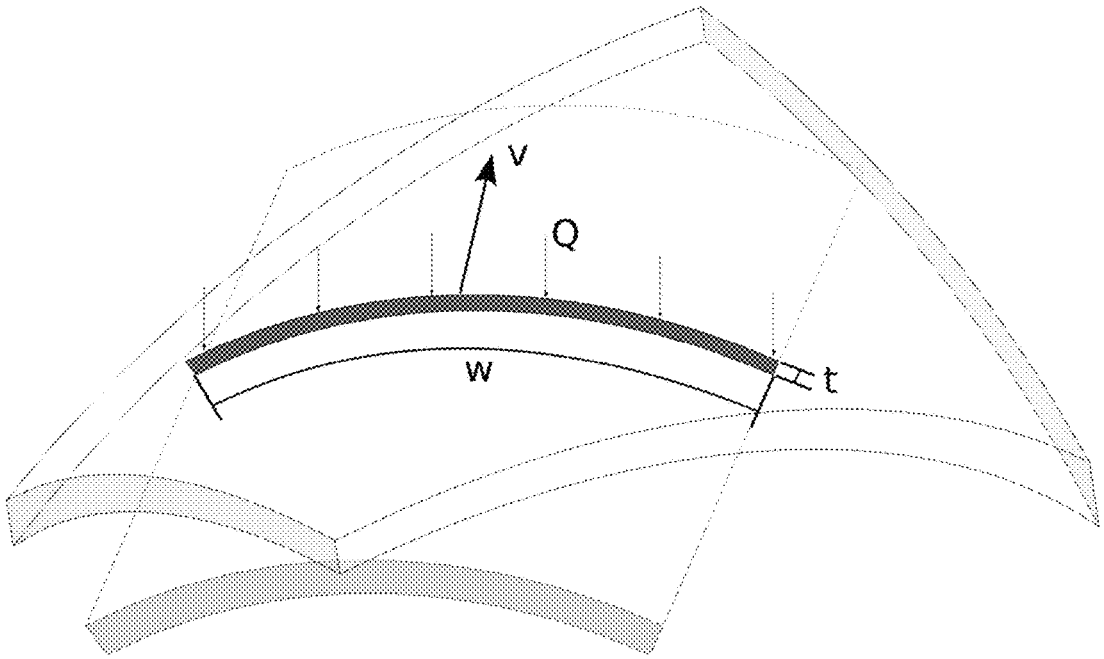
FIG. 1 provides a schematic describing the general method of forming a metallic glass sheet in accordance with embodiments of the present disclosure.

The present disclosure is directed to methods and apparatus for forming metallic glasses objects, such as metallic glass sheets or tubes, by melt deposition processes. In many embodiments the methods and apparatus incorporate melt deposition processes in which a molten alloy is deposited inside a channel formed by two substrates, and shaped and quenched by conduction to the substrates in a manner that enables the melt to vitrify, i.e. to transform to the metallic glass phase. In some embodiments, the deposition method allows the melt to be deposited and formed while being quenched without undergoing shear flow.

Conventional methods for forming high aspect ratio metallic glass objects, such as metallic glass sheets, typically involve a process where melt shear flow and melt quenching are coupled. Specifically, in these methods the melt is shaped into a sheet by undergoing shear flow while simultaneously being quenched. The coupling between shear flow and quenching gives rise to complications that hinder the development of the metallic glass sheet. For example, the complications include lack of uniformity of the formed metallic glass sheet, production of surface defects, and crystallization. Specifically:

- The melt cooling process dynamically increases in melt viscosity such that the shear flow process is dynamically slowed resulting in difficulty in controlling the thickness of the sheet.
- The coupling between cooling and shearing gives rise to shear banding as the glass transition is approached, which may result in the production of tears, cracks, or other structural defects in the sheet.
- Shear flow is also found to accelerate the rate of crystallization and consequently crystallites may evolve as the material is cooled through its undercooled region.

The above complications, which are direct consequences of the coupling between cooling and shearing of the melt inherent in these conventional methods, contribute to the lack of a commercially-robust sheet fabrication process for metallic glasses.

According to many embodiments of methods and apparatus for performing melt deposition processes presented herein, the deposition method allows the melt to be deposited and formed while being quenched without undergoing shear flow to form objects. In some embodiments the objects are high aspect ratio parts, such as metallic glass sheets and tubes.

It should be understood that in the context of the present disclosure, the term 'without undergoing shear flow' refers to shearless melt deposition processes in which the melt shearing rate between the substrates is substantially low or approximately zero. In some embodiments, the melt shearing rate between the substrates is less than V/t. In other embodiments, the melt shearing rate between the substrates is less than 0.5V/t. In other embodiments, the melt shearing rate between the substrates is less than 0.1V/t. In other embodiments, the melt shearing rate between the substrates is less than 0.01V/t. In other embodiments, the melt shearing rate between the substrates is less than 1 $s^{-1}$. In other embodiments, the melt shearing rate between the substrates is less than 0.1 $s^{-1}$. In yet other embodiments, the melt shearing rate between the substrates is less than 0.01 $s^{-1}$. In yet other embodiments, the melt shearing rate between the substrates is less than 0.001 $s^{-1}$.

It should be understood that in the context of the present disclosure, the term substrates refers to objects that can have any arbitrary shape; however, they include surfaces with matching contours such that they can be arranged with mating surfaces facing each other in parallel at a gap distance t to form a channel of thickness t. In other words, the thickness t of the channel can be equal to the gap distance t between the mating surfaces of the substrates.

In some embodiments, the substrates can have plate-like in shape to form metallic glass sheets. In other embodiments, the chill substrate may be a conveyor belt. In other embodiments, the substrates can have tubular geometry to form metallic glass tubes. In other embodiments, the substrate can have an arc-shape geometry. In still other embodiments, it should be understood any geometry or arrangement of substrates may be provided such that a channel suitable for melt deposition is formed therebetween.

In the context of the present disclosure, the thickness t is uniform such that it does not vary by more than 10% at any two locations along the gap. In some embodiments, the thickness t does not vary by more than 5% at any two locations along the gap. In yet other embodiments, the thickness t does not vary by more than 1% at any two locations along the gap.

In embodiments of the apparatus and method, a molten alloy capable of forming metallic glass is deposited into the channel between the substrates at a deposition rate Q (in $m^3/s$). In some embodiments, the deposition rate Q is equal to a product (V*t*w). In other embodiments, the deposition rate Q may vary from the product (V*t*w) by up to 20%. In yet other embodiments, the deposition rate Q may vary from the product (V*t*w) up to 10%. In other embodiments, the deposition rate Q may vary from the product (V*t*w) up to 5%.

a. It should be understood that in the context of the present disclosure, a high aspect ratio metallic glass refers to metallic glass objects that can have any arbitrary shape; however, the smallest dimension of the object is equal to or less than 20% of any of the larger dimensions of the object. In some embodiments, the smallest dimension of the high aspect ratio metallic glass object is equal to or less than 10% of any of the larger dimensions of the object. In other embodiments, the smallest dimension of the high aspect ratio object is equal to or less than 5% of any of the larger dimensions of the object. In some embodiments, a high aspect ratio metallic glass sheet would have a thickness that is equal to or less than 20% of its width and length. In another embodiment, a high aspect ratio metallic glass tube would have a wall thickness that is equal to or less than 20% of the tube inner diameter or outer diameter, and the tube length.

As illustrated in FIG. 1, many embodiments disclose methods and apparatus for forming a metallic glass object of thickness t and width w by employing two substrates separated by a gap t, arranged parallel to each other, where one substrate is movable relative to the other substrate such that a relative velocity V is established between the substrates. In particular, w represents the overlapping width perpendicular to the direction of V. In embodiments of such a process or apparatus, the molten alloy capable of forming metallic glass is extracted along w and deposited between the substrates at a deposition rate Q (in $m^3/s$). As shown in FIG. 1, the melt may be injected along any overlapped section at any angle.

A metallic glass formed according to this method will have thickness t and will be shaped according to the shape of the channel formed by the mating surfaces of the substrates. In other words, the thickness t of the metallic glass is equal to the thickness t of the channel (i.e. the variations between the metallic glass and channel thickness are less than 10% and in some embodiments less than 5%).

Figure 2:
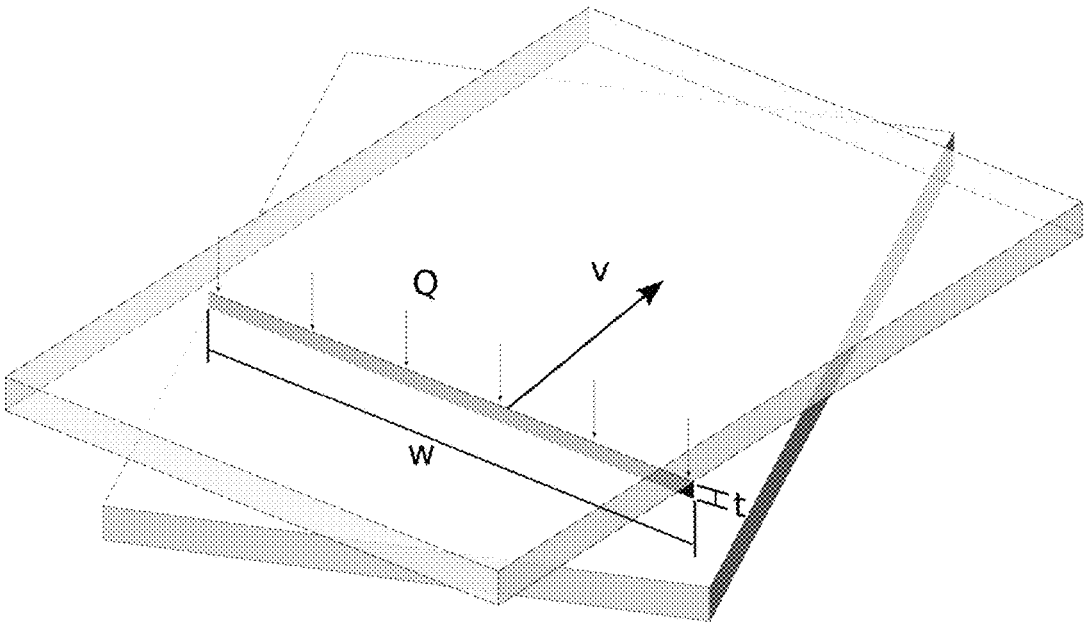
FIG. 2 provides a schematic illustrating the method to produce a flat sheet in accordance with embodiments of the present disclosure.

In some embodiments, the mating substrates are planar and flat, and a metallic glass sheet is formed that is likewise planar and flat. This embodiment is illustrated schematically in FIG. 2. As shown in FIG. 2, in such embodiments the molten alloy may be injected along any overlapped section at any angle, and having any dimensions (thickness t or width w) suitable.

Figure 3:
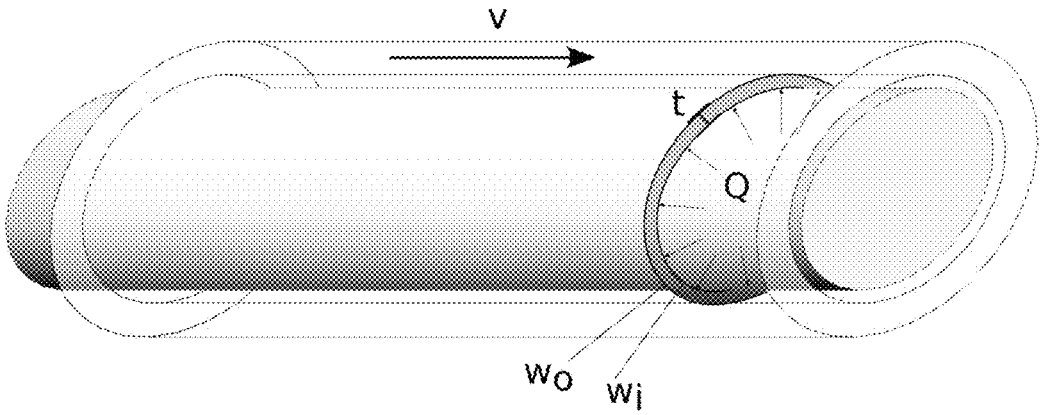
FIG. 3 provides a schematic describing the general method of forming a metallic glass tube in accordance with embodiments of the present disclosure.

In other embodiments, as illustrated in FIG. 3, the disclosed methods involve forming a metallic glass tube of wall thickness t and exterior and interior circumferences $w_o$ and $w_i$ by employing two tubular shaped substrates, where the interior circumference of one of the substrates $w_o$ (exterior substrate) is larger than the exterior circumference of the other substrate $w_i$ (interior substrate), i.e. $w_o>w_i$, arranged concentrically with the interior substrate inside the exterior substrate such that they are separated by a gap t, and where one substrate is movable relative to the other substrate such that a relative velocity V is established between the substrates. In many such embodiments, the exterior and interior substrates include tubular or tube-like exterior and interior surfaces that can be arranged concentrically with the mating surfaces facing each other in parallel at a gap t to form a tubular channel of thickness t. A tube formed according to this method will have thickness t and will be shaped according to the shape of the channel formed by the mating surfaces of the substrates. In other words, the wall thickness t of the metallic glass tube is equal the thickness t of the tubular channel (i.e. the variations between the metallic glass tube and tubular channel thickness are less than 10% and in some embodiments less than 5%). In this process, the molten alloy capable of forming metallic glass is extracted along $w_o$ or $w_i$ and deposited between the substrates at a deposition rate Q (in $m^3/s$).

In some embodiments of the disclosure, the interior substrate is a solid rod-like shape. In other embodiments, the concentric substrates are circular and the metallic glass tube formed is likewise circular. In other embodiments, the concentric substrates can be elliptical and the metallic glass tube formed is likewise elliptical.

Some parameters can be adjusted in embodiments of the apparatus and method, including the materials of the substrates, the shape of the substrates, the temperature of the substrates, the thickness t, the width w, the relative velocity between the substrates V, and the deposition rate Q.

The gap between the substrates t, which also defines the sheet or tube wall thickness, can be influenced by proprieties of the alloy that is selected for forming the metallic glass. There is a maximum thickness up to which an alloy is capable of forming the metallic glass phase by quenching from the high-temperature molten state, referred to as the critical casting thickness. In some embodiments, the thickness t can be set to be equal to or below the critical casting thickness of the alloy.

In other embodiments, the thickness t is chosen such that the thermal relaxation time (i.e. the Fourier number), $\tau_{th}$, representing the time required for the melt temperature to drop by about 1/e where e=2.71 is Euler's constant (i.e. about 37%) of the temperature difference between the melt initial temperature and the substrate temperature, does not exceed the minimum time required for the melt to crystallize in the undercooled state, $\tau_{cr}$. The time for an undercooled metallic melt to crystallize, $\tau_{cr}$, varies with the temperature of the undercooled melt. The time to crystallize as a function of temperature is known as the Time-Temperature-Transformation (TTT) diagram. The crystallization time can be longer just below the liquidus temperature and just above the glass transition temperature, and shorter at intermediate undercooling temperatures. As such, the TTT diagram exhibits a "C" shape, and the crystallization time crosses a minimum at a unique temperature in the undercooled region. This minimum crystallization time at the "nose" of the C-shaped curve is denoted by $\tau_{cr}$. The temperature associated with the minimum crystallization time is termed the "nose temperature". For alloys capable of forming metallic glasses, the nose temperature is approximately 80% of the liquidus temperature (measured in Kelvin).

In yet other embodiments, the thickness t is chosen such that the thermal relaxation time, $\tau_{th}$, is adjusted to match the rate at which the molten alloy cools to the glass transition temperature bypassing the crystallization transition, thereby vitrifying and forming the metallic glass phase.

In certain embodiments, the temperature of the substrates is sufficiently low such that the melt is quenched by conduction to the substrates at a rate greater than the critical cooling rate required to bypass crystallization thereby enabling the melt to vitrify, i.e. to transform to the metallic glass phase. In some embodiments, the temperature of the substrates is below the nose temperature of the metallic glass. In other embodiments, the temperature of the substrates is below the glass transition temperature of the metallic glass. In yet other embodiments, the temperature of the substrates is below 200° C. In yet other embodiments, the temperature of the substrates is below 100° C. In yet other embodiments, the temperature of the substrates is below 50° C.

In some embodiments, the metallic glass sheet or tube is formed by depositing the molten alloy at a deposition rate as given by the following equation:

$$Q=V\times t\times w \quad \text{Eq. (1)}$$

In the embodiments directed to forming a metallic glass tube using tubular shaped substrates, w in Eq. 1 is the mean tube circumference given by $w=(w_o+w_i)/2$. In some embodiments, the molten alloy is deposited between the substrates at a rate Q equal to the rate of relative motion between the substrates. In other embodiments, the molten alloy is deposited between the substrates at a rate Q that does not vary by more than 20% of the product (V×t×w). In yet other embodiments, the molten alloy is deposited between the substrates at a rate Q that does not by more than 10% of the product (V×t×w).

In other embodiments, the metallic glass sheet or tube is formed by depositing the molten alloy at a deposition rate of Q as given in Eq. (1), where one substrate is moving relative to the other substrate at a velocity $$V=t/\tau_{th} \quad \text{Eq. (2)}$$

In these embodiments, the molten alloy is deposited at a rate equal to the rate required for the melt temperature to drop by about 37% of the temperature difference between the melt initial temperature and the substrate temperature. In other embodiments, the melt is deposited at a rate equal to the rate required for the melt temperature to drop by a fraction of the temperature difference between the melt initial temperature and the substrate temperature, wherein the fraction is between 30-45%. In yet other embodiments, the molten alloy is deposited at a rate equal to the rate required for the melt temperature to drop by a fraction of the temperature difference between the melt initial temperature and the substrate temperature, wherein the fraction is between 25-50%.

In some embodiments, if the thickness t is chosen such that the thermal relaxation time is less than the minimum crystallization time (i.e. $\tau_{th}<\tau_{cr}$), then the molten alloy can be deposited at a rate higher than the rate required to bypass the crystallization transition. In other embodiments, if the thickness t is chosen such $\tau_{th}$ approximately matches (i.e. within 20%, and in some embodiments within 10%) the time at which the molten alloy cools to the glass transition temperature, then the molten alloy would be deposited at the same rate as the rate required to form the metallic glass phase.

In certain embodiments, the thickness t can be selected based on the choice of the substrate materials, the thermal diffusivity of the molten alloy α, and the minimum crystallization time of the metallic glass alloy $\tau_{cr}$. In some embodiments, both substrates may comprise a material with high thermal diffusivity (i.e. with thermal diffusivity greater than order of $10^{-4}$ $m^2/s$, such as copper), and the thickness t can be selected such that $t<\sqrt{(\alpha\cdot\tau_{cr})}$. In certain embodiments when such substrates are used, the thickness t can be selected to be less than the critical casting thickness of the alloy. In other embodiments, one substrate may comprise a material with high thermal diffusivity (i.e. with thermal diffusivity greater than order of $10^{-4}$ $m^2/s$, such as copper) and the other substrate may comprise a material with low thermal diffusivity (i.e. with thermal diffusivity less than order of $10^{-6}$ $m^2/s$, such as silicate glass), and the thickness t can be selected such that $t<0.5\sqrt{(\alpha\cdot\tau_{cr})}$. In certain embodiments when such substrates are used, the thickness t can be selected to be less than half of the critical casting thickness of the alloy. In yet other embodiments, the substrates may comprise materials with intermediate thermal diffusivity (i.e. with thermal diffusivity on the order of $10^{-5}$ $m^2/s$), and the thickness t can be selected such that $t<0.75\sqrt{(\alpha\cdot\tau_{cr})}$. In certain embodiments when such substrates are used, the thickness t can be selected to be less than 75% of the critical casting thickness of the alloy.

In other embodiments, the thickness t is less than 2 mm. In yet other embodiments, the thickness t is less than 1 mm. In yet other embodiments, the thickness t is less than 0.75 mm. In yet other embodiments, the thickness t is less than 0.5 mm. In other embodiments, the thickness t is in the range of 0.1 mm to 1 mm. In yet other embodiments, the thickness t is in the range of 0.2 mm to 0.8 mm.

In certain embodiments, the velocity V can be selected based on the choice of the substrate materials, the thermal diffusivity of the molten alloy α, and the thickness t. In some embodiments, both substrates may comprise a material with high thermal diffusivity (i.e. with thermal diffusivity greater than order of $10^{-4}$ $m^2/s$, such as copper), and the velocity V can be selected such that $0<V\leq 2\alpha/t$. In other embodiments, one substrate may comprise a material with high thermal diffusivity (i.e. with thermal diffusivity greater than order of $10^{-4}$ $m^2/s$, such as copper) and the other substrate may comprise a material with low thermal diffusivity (i.e. with thermal diffusivity less than order of $10^{-6}$ $m^2/s$, such as silicate glass), and the velocity V can be selected such that $\alpha/t<V\leq 3\alpha/t$. In yet other embodiments, the substrates may comprise materials with intermediate thermal diffusivity (i.e. with thermal diffusivity on the order of $10^{-5}$ $m^2/s$), and the velocity V can be selected such that $0.5\alpha/t<V\leq 3.5\alpha/t$.

In other embodiments, the velocity V is in the range of 0.1 mm/s to 10 cm/s. In other embodiments, the velocity V is in the range of 0.5 mm/s to 5 cm/s. In yet other embodiments, the velocity V is in the range of 1 mm/s to 1 cm/s.

In certain embodiments, the melt deposition rate Q can be selected based on the choice of the substrate materials, the thermal diffusivity of the molten alloy α, and the width w. In some embodiments, both substrates may comprise a material with high thermal diffusivity (i.e. with thermal diffusivity greater than order of $10^4$ $m^2/s$, such as copper), and the melt deposition rate Q can be selected such that $0<Q\leq 2\alpha w$. In other embodiments, one substrate may comprise a material with high thermal diffusivity (i.e. with thermal diffusivity greater than order of $10^{-4}$ $m^2/s$, such as copper) and the other substrate may comprise a material with low thermal diffusivity (i.e. with thermal diffusivity less than order of $10^{-6}$ $m^2/s$, such as silicate glass), and the melt deposition rate Q can be selected such that $\alpha w<V\leq 3\alpha w$. In yet other embodiments, the substrates may comprise materials with intermediate thermal diffusivity (i.e. with thermal diffusivity on the order of $10^{-5}$ $m^2/s$), and the melt deposition rate Q can be selected such that $0.5\alpha w<V\leq 3.5\alpha w$.

In other embodiments, the melt deposition rate Q is in the range of $10^{-6}$ $m^3/s$ to $10^{-3}$ $m^3/s$. In other embodiments, the melt deposition rate Q is in the range of $5\times10^{-6}$ $m^3/s$ to $0.5\times10^{-3}$ $m^3/s$. In yet other embodiments, the melt deposition rate Q is in the range of $10^{-5}$ $m^3/s$ to $10^{-4}$ $m^3/s$.

In some embodiments, the molten alloy may be overheated, such that the glass-forming ability of the alloy and the toughness of the metallic glass sheet or tube can be improved. In some such embodiments, the molten alloy temperature prior to being deposited is at least 100° C. higher than the alloy liquidus temperature $T_L$. In yet another embodiment, the melt temperature of the alloy prior to being deposited is at least 300° C. higher than the liquidus temperature of the alloy. In yet another embodiment, the melt temperature of the alloy prior to being deposited is at least 20° C. higher than the liquidus temperature of the alloy.

In other embodiments, the metallic glass forming alloy is based on any of the following metals: Zr, Ti, Ta, Y, Hf, Ni, Pd, Pt, Fe, Ni, Co, Cu, Au, Al, La, Ce, Pr, Ng, Gd, Mg, Ca, or combinations thereof.

In still other embodiments, at least one of the two substrates has a thermal conductivity of at least 20 W/m-K. In another embodiment, at least one of the two substrates has a thermal conductivity of at least 80 W/m-K.

In yet other embodiments, at least one of the substrates includes a metal or metal alloy. In another embodiment, at least one of the substrates includes a metal or metal alloy selected from a group including copper, bronze, brass, steel, aluminum, and aluminum alloy, among others.

In still yet other embodiments, at least one of the two substrates has a thermal conductivity of equal to or less than 20 W/m-K. In another embodiment, at least one of the two substrates has a thermal conductivity of equal to or less than 5 W/m-K.

In still yet other embodiments, one of the substrates comprises a ceramic. In another embodiment, one of the substrates comprises a ceramic selected from a group including zirconia, alumina, and silicate glass, among others.

In some embodiments, as shown schematically in FIGS. 2 and 4-6, a metallic glass sheet may be formed using an apparatus using plate-like substrates. In such an apparatus, a flat guide substrate 10130 of width w moves over a flat stationary chill substrate 10230 at velocity V with their mating surfaces in parallel separated by a gap with height or thickness t. The guide substrate 10130 may be connected to a melt reservoir 10110 in which the molten alloy is contained via a thin longitudinal nozzle 10120 extending across the width w. In some such embodiments, the guide substrate is held at a temperature lower than the temperature of the melt reservoir and nozzle.

Figure 4:
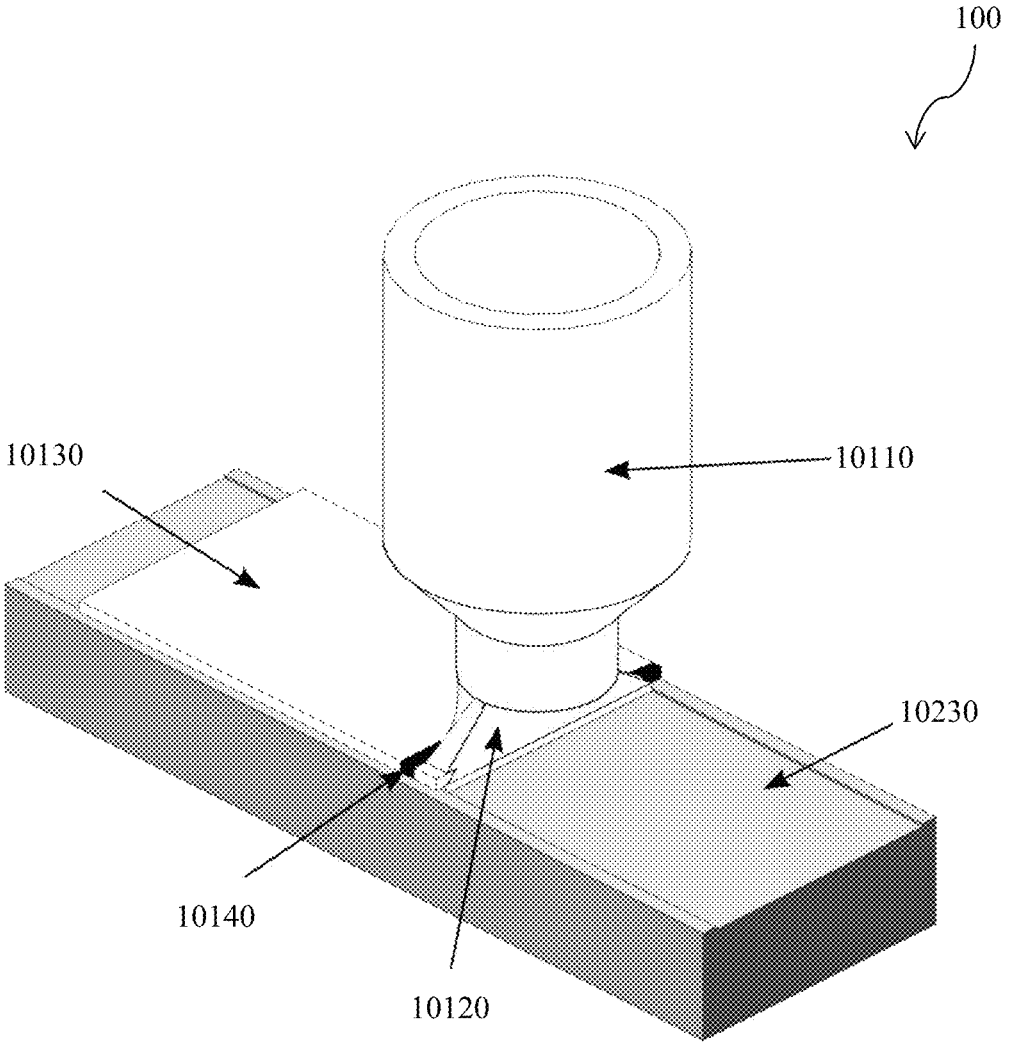
FIG. 4 provides a schematic illustrating an isometric view of an apparatus in accordance with embodiments of the present disclosure.
Figure 5:
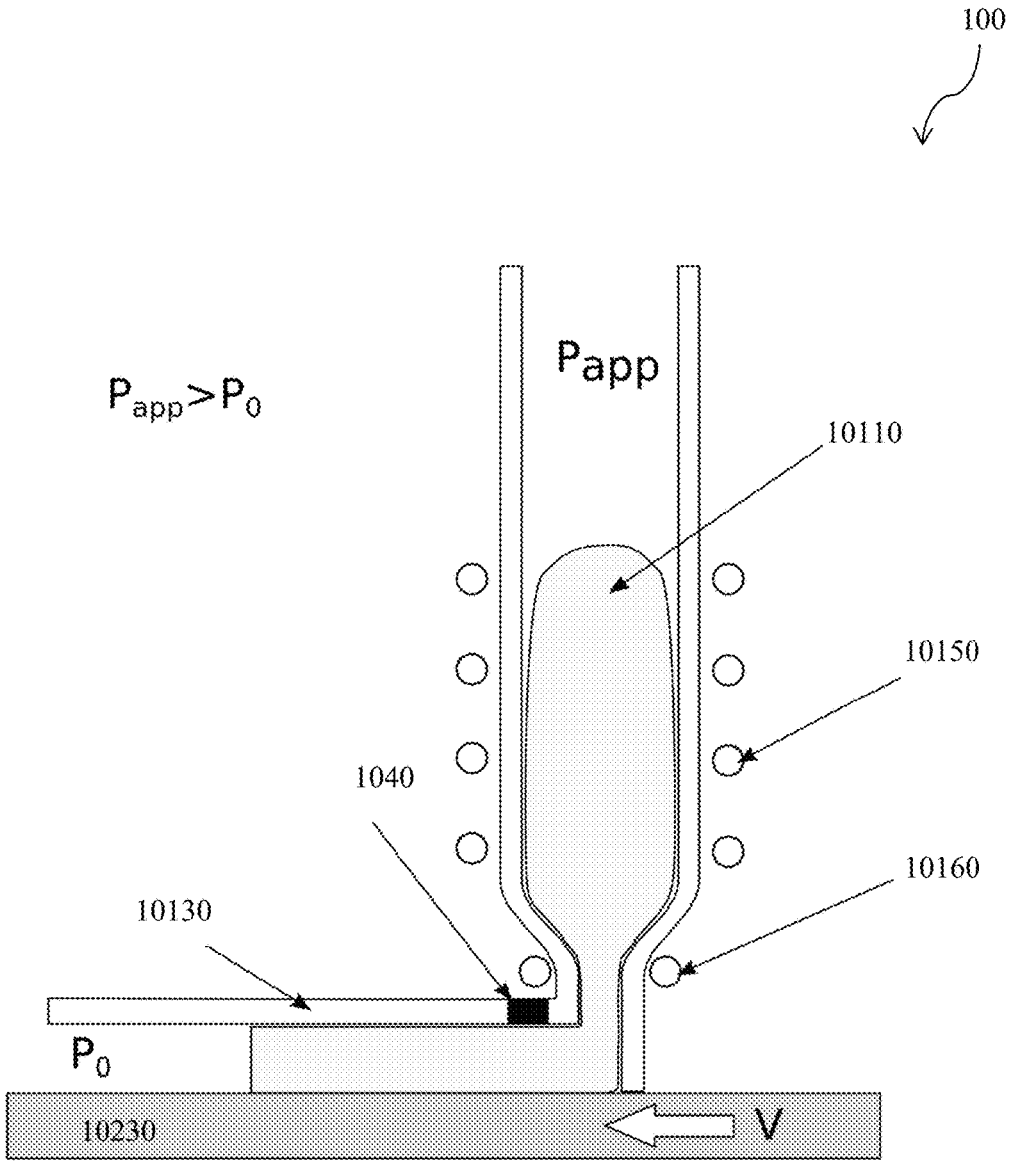
FIG. 5 provides a schematic illustrating a cross-sectional view of the apparatus of FIG. 4.

In some embodiments, as illustrated in FIGS. 4 and 5, the guide substrate is held at a lower temperature than the melt reservoir and nozzle. In some such embodiments, the guide substrate 10130 is thermally isolated from the melt reservoir 10110 and nozzle 10120 by means of a thermal insulator 10140.

In some embodiments, the guide substrate may also comprise a lip or step (not shown) along the outer edge of the nozzle on the side of relative motion of the chill substrate having a width w and a height t.

In many embodiments, the molten alloy is heated in the melt reservoir 10110 by a heating coil 10150, and the molten alloy temperature at the nozzle 10120 is controlled by a nozzle heating coil 10160. The molten alloy may be extracted through the nozzle 10122 by applying a pressure $P_{app}$ to the molten alloy in the reservoir 10110 that is greater than the ambient pressure in the channel $P_o$ such that the molten alloy is injected through the nozzle 10120 with a net positive pressure $P_{app}-P_o$ and at a flow rate or deposition rate Q.

In some embodiments, the chill substrate may include two parallel lips of height t separated by a distance w defining a channel of rectangular cross section having a width w and a height t over which the chill plate may be configured to slide.

In an alternative embodiment, the guide substrate may move while the chill substrate is stationary, and in still other embodiments both plates may move relative to each other.

Although the embodiment in FIGS. 4 and 5 present a flat sheet, the curvature may vary. It will be appreciated by those skilled in the art that the curvature may be elliptical or angular, or any other shape, configuration or geometry.

Figure 6:
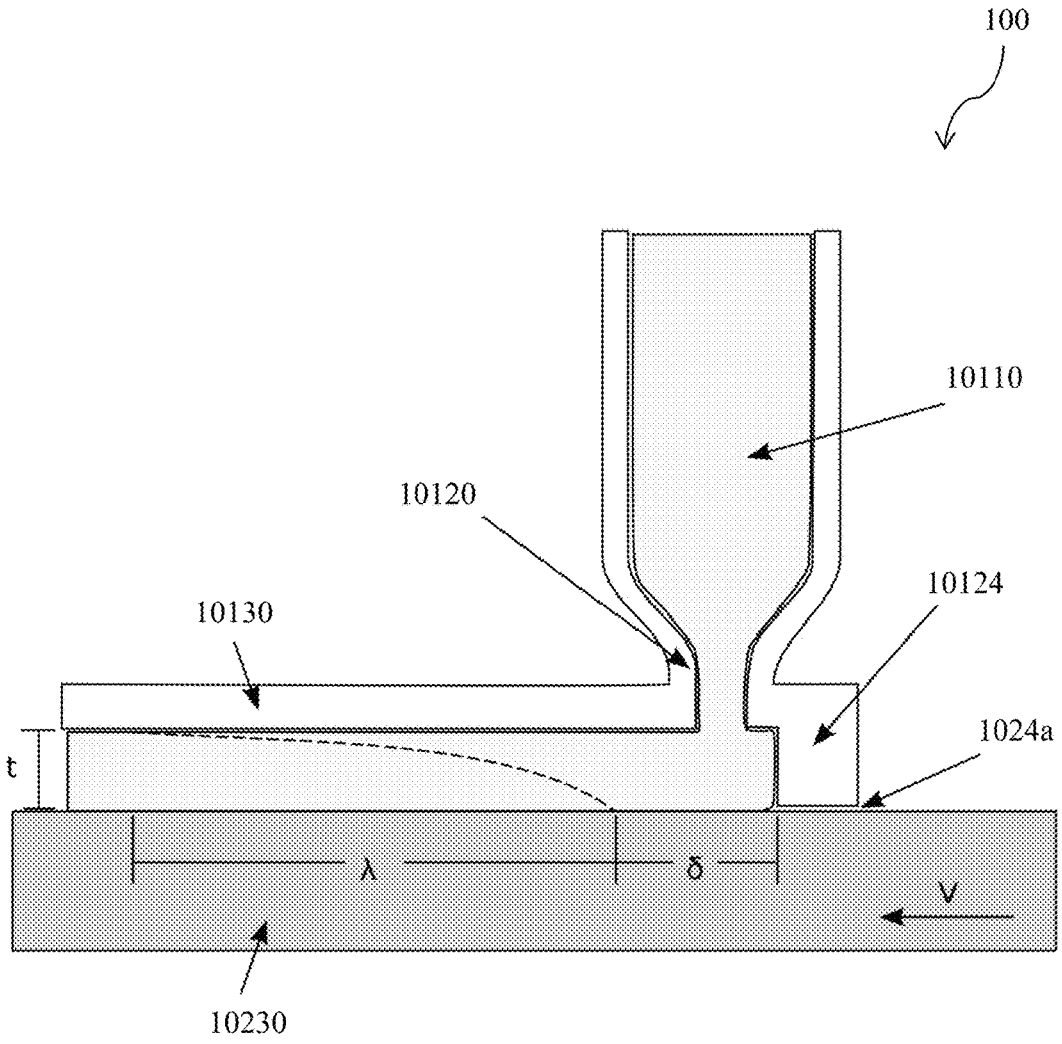
FIG. 6 provides a schematic illustrating a cross-sectional view of the apparatus of FIG. 4 with the various thermal regions indicted.

In other embodiments, as shown in FIG. 6, the melt from the molten alloy reservoir may be deposited through the nozzle and onto the chill substrate under a positive pressure within a hot pool of length δ, which may be drawn away from the nozzle by the relative motion of the chill substrate at velocity V. The deposited melt may be cooled by conduction to the substrates within a chill zone over a distance λ outside of the hot pool while being confined between the substrates. The deposited material will spend an amount of time, $\tau_h=\delta/V$, in the hot pool, and an amount of time, $\tau_c=\lambda/V$, in the chill zone.

In one embodiment, the length of the chill zone λ can be such that the average temperature in the chill zone across the thickness t is below the nose temperature, and the length of the hot pool δ can be such that the average temperature in the hot pool across the thickness t is above the nose temperature. In another embodiment, the length of the chill zone λ can be such that the average temperature in the chill zone across the thickness t is below the glass-transition temperature, and the length of the hot pool δ can be such that the average temperature in the hot pool across the thickness t is above the glass-transition temperature.

In some embodiments, the molten alloy may undergo shear flow while in the hot pool. In one embodiment, the shearing rate in the hot pool is less than the value 2 t/V. In another embodiment, the shearing rate in the hot pool is less than the value t/V. In another embodiment, the shearing rate in the hot pool is less than the value 0.5 t/V. In other embodiments, the molten alloy may undergo limited shear flow while in the chill zone. In one embodiment, the shearing rate in the chill zone is less than the value 0.2 t/V. In another embodiment, the shearing rate in the chill zone is less than the value 0.1 t/V. In another embodiment, the shearing rate in the chill zone is less than the value 0.05 t/V.

In one embodiment, the chill substrate comprises a material of high thermal diffusivity, while the guide substrate comprises a material of low thermal diffusivity. An apparatus according to such embodiment is presented schematically in FIG. 6. An isothermal contour is shown representing the interface between the hot pool and chill zone. In an embodiment where the chill substrate comprises a material of near-infinite thermal diffusivity while the guide substrate comprises a material of near-zero thermal diffusivity, the thermal relaxation time is $\tau_{th}=4\ t^2/\alpha$. In such embodiments, the time the material spends in the hot pool and chill zone may be such that $\tau_h<\tau_c<\tau_{th}$. In another embodiment, both the chill substrate and the guide substrate comprise materials of high thermal diffusivity.

In certain embodiments, the process takes place under steady-state conditions. It should be understood that in the context of the present disclosure, the term steady state refers to the condition where the temperature at a given location between the substrates varies by less than 20% over 100 s. In other embodiments, the term steady state refers to the condition where the temperature at a given location between the substrates varies by less than 10% over 100 s. In yet other embodiments, the term steady state refers to the condition where the temperature at a given location between the substrates varies by less than 5% over 100 s. In yet other embodiments, the term steady state refers to the condition where the δ and/or λ vary by less than 20% over 100 s. In yet other embodiments, the term steady state refers to the condition where the δ and/or λ vary by less than 10% over 100 s. In yet other embodiments, the term 'steady state' refers to the condition where the δ and/or λ vary by less than 5% over 100 s.

In certain embodiments where steady state is established, S includes the region where the nozzle deposits the liquid onto the chill plate so that the liquid in the nozzle will not freeze before being deposited. In other embodiments where steady state is established, λ does not extend beyond the end of the guide plate so that the liquid remains confined while being cooled.

In certain embodiments, as the liquid is deposited under positive pressure, it may be confined to prevent unwanted shear flow. In some embodiments, gaps may exist between some of the apparatus components. A "step gap" is shown in FIG. 6 between the step and the chill substrate. The thickness of the gaps may be limited so that the liquid does not flow out of the confined area. In one embodiment, a gap has thickness less than 20% of t. In another embodiment, a gap has thickness less than 10% of t. In yet one embodiment, a gap has thickness less than 5% of t.

Figure 7:
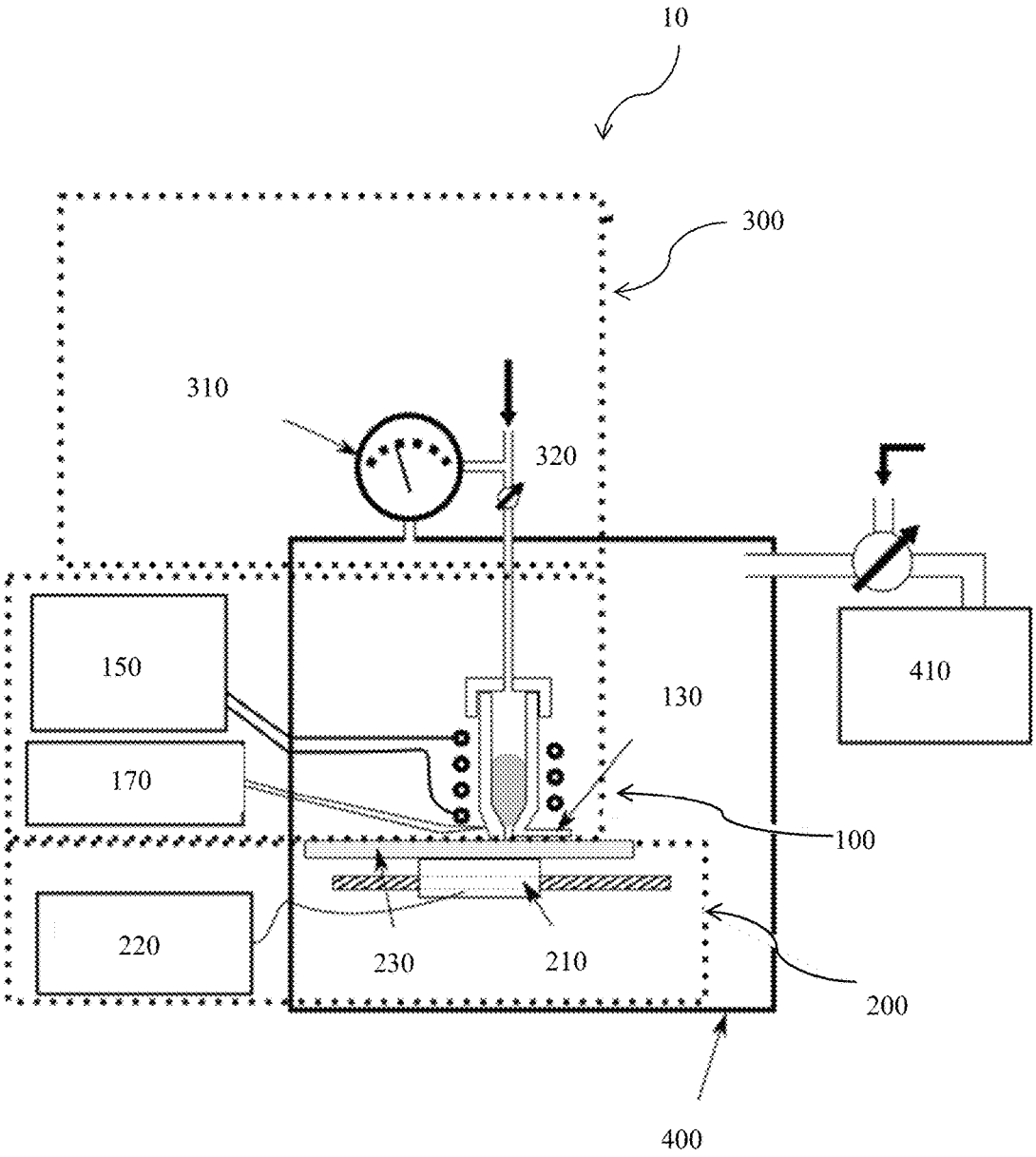
FIG. 7 provides a schematic illustrating an apparatus for producing metallic glass by melt deposition in accordance with embodiments of the present disclosure.

In some embodiments, as shown schematically in FIG. 7, an apparatus 10 for producing a metallic glass by melt deposition may comprise three main components: (1) the crucible/nozzle system 100, (2) the chill substrate/motion system 200, and (3) the deposition control system 300. In one embodiment, as shown in FIG. 7, the crucible/nozzle system 100 comprises a crucible 110 for containing the molten alloy, a nozzle 120, and a guide substrate 130. The crucible/nozzle system further comprises an induction power supply 150 to heat the molten alloy. In some embodiments, the apparatus further comprises a thermocouple reader 170 to monitor the temperature of the molten alloy. The chill substrate/motion system 200 comprises a chill substrate 230, at least one actuator 210 to provide differential motion between substrates 130 and 230, and an actuator control system 220. The deposition control system 300 comprises a gas pressure/flow controller 310 and a pressure/gas control valve 320.

In certain embodiments, an apparatus 10 for producing a metallic glass by melt deposition may also comprise an environmental chamber 400 for atmosphere control. As shown, the environmental chamber 400 is configured to house the crucible/nozzle system 100 and the chill substrate/motion system 200. Apparatus 10 further comprises a vacuum pump 410 and a valve 420 in fluid communication with environmental chamber 400. In other embodiments, the vacuum pump may also be disposed to be housed within the environmental chamber.

Figure 8:
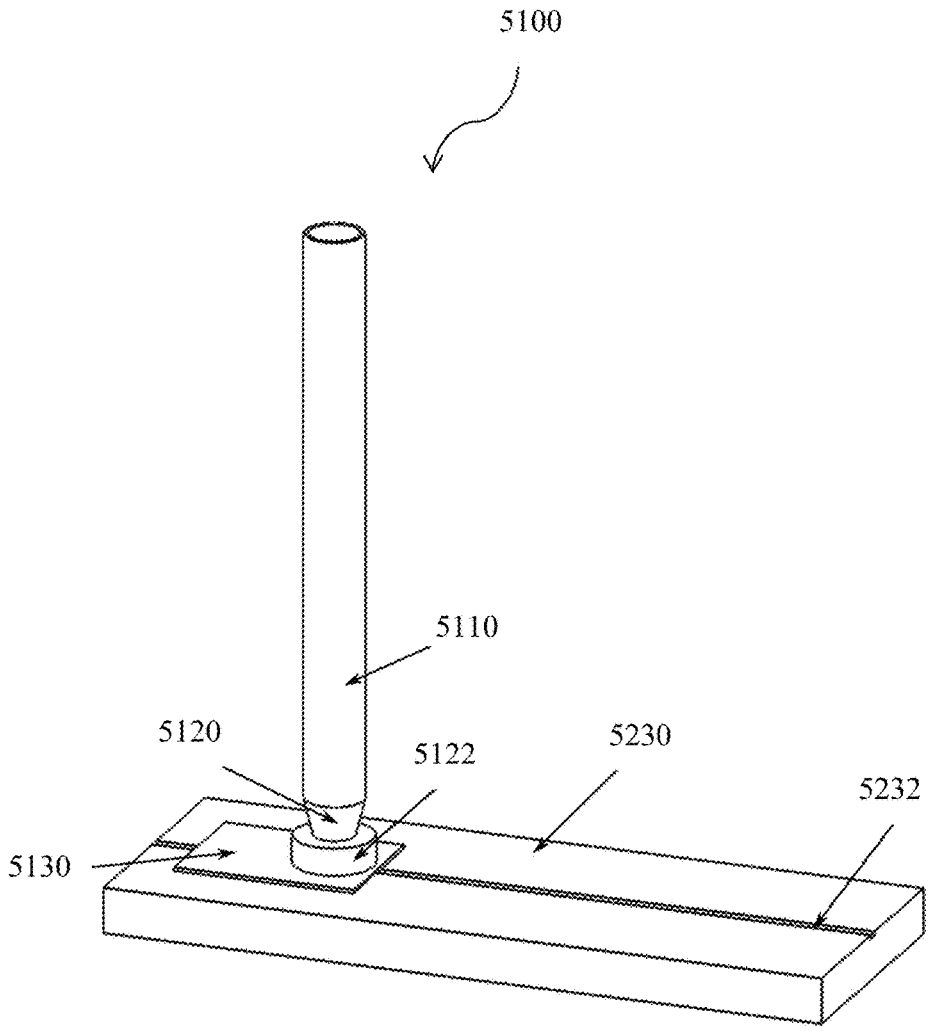
FIG. 8 provides a schematic illustrating a crucible/nozzle system in accordance with embodiments of the present disclosure.

The Crucible/Nozzle System:

As illustrated in FIG. 8, an exemplary embodiment of the crucible/nozzle system 5100 comprises the crucible 5110 in which the glass-forming alloy is melted, the orifice or nozzle 5120 through which the molten alloy is deposited, and the guide substrate 5130. The crucible/nozzle system 5100 is disposed so as to be above a chill substrate 5230, with a channel 5232, to enable the molten alloy to be extracted through nozzle 5120 and deposited into the channel 5232.

In some embodiments, the crucible 510, which contains the molten alloy, may comprise a material that does not chemically react with the molten alloy and remains stable at the temperatures at which the molten alloy will be held. In the context of this disclosure, "chemical reaction" of the crucible with the molten alloy (i.e. the dissolution of a portion of the crucible in the molten alloy during the melt deposition process) is negligible. In some embodiments the chemical reaction of the crucible with the molten alloy is at concentrations of less than 500 ppm (parts per million), and in some embodiments less than 100 ppm, while in other embodiments less than 50 ppm. The crucible remains stable at the temperatures at which the molten alloy will be held. In the context of this disclosure, to remain stable the crucible does not chemically decompose or lose its shape or mechanical integrity.

The crucible can be formed from a variety of materials that remain stable at the temperatures at which the molted alloy will be held. For example, in one embodiment, the crucible can comprise fused silica glass. In another embodiment, the crucible can comprise a ceramic such as alumina of zirconia. In yet another embodiment, the crucible can comprise graphite. In yet another embodiment, the crucible can comprise sintered crystalline silica.

The nozzle 5120 is shaped to extract and deposit the molten alloy in a controlled manner while allowing the molten alloy to be deposited evenly and continuously in the channel 5232 between the two substrates (guide substrate 5130 and chill substrate 5210). In one embodiment, as shown schematically in FIGS. 8 and 9, the nozzle 5120 is integrally formed as the tapered base of the crucible 5110 with an orifice (not shown) configured to allow for flow of molten alloy onto the chill substrate 5230. In alternative embodiments, a step (not shown) may be attached on the foot, or formed as an integral part of the foot, to prevent the molten alloy from flowing in a direction opposite to the relative motion of the guide substrate and chill substrate. In other alternative embodiments, the nozzle may be removably affixed to the crucible.

Figure 9:
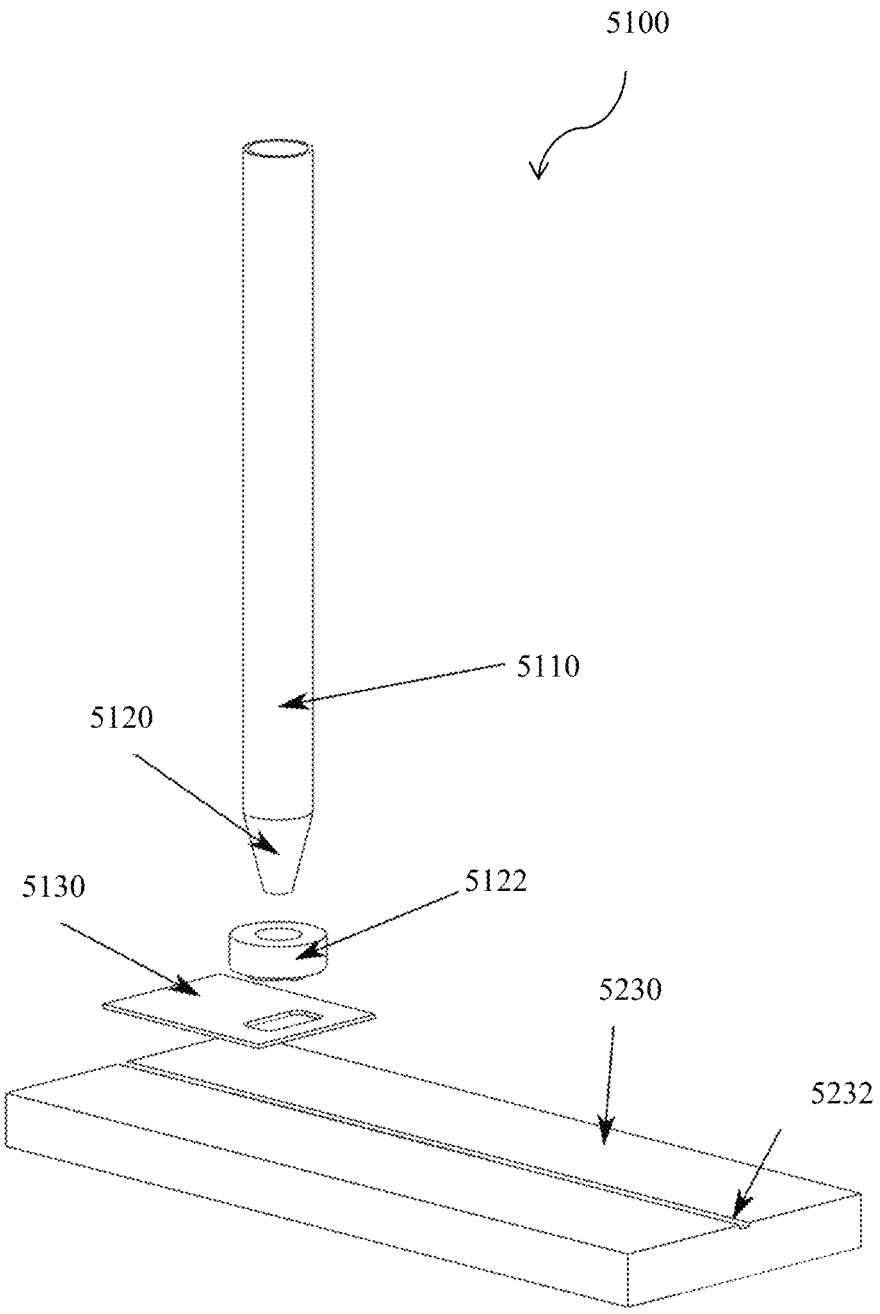
FIG. 9 provides an exploded view of the crucible/nozzle system of FIG. 8.

In certain embodiments, the molten alloy may be heated inductively. In such an embodiment, as illustrated in FIGS. 8 and 9, a nozzle foot 5122 is used that comprises a material that is susceptible to inductive heating, such as graphite. A nozzle foot capable of inductive heating allows for finer control of the melt temperature at the nozzle orifice.

As illustrated, the guide substrate 5130 is shaped so that the nozzle foot 5122 is removably attached to the guide substrate 5130.

Figure 10:
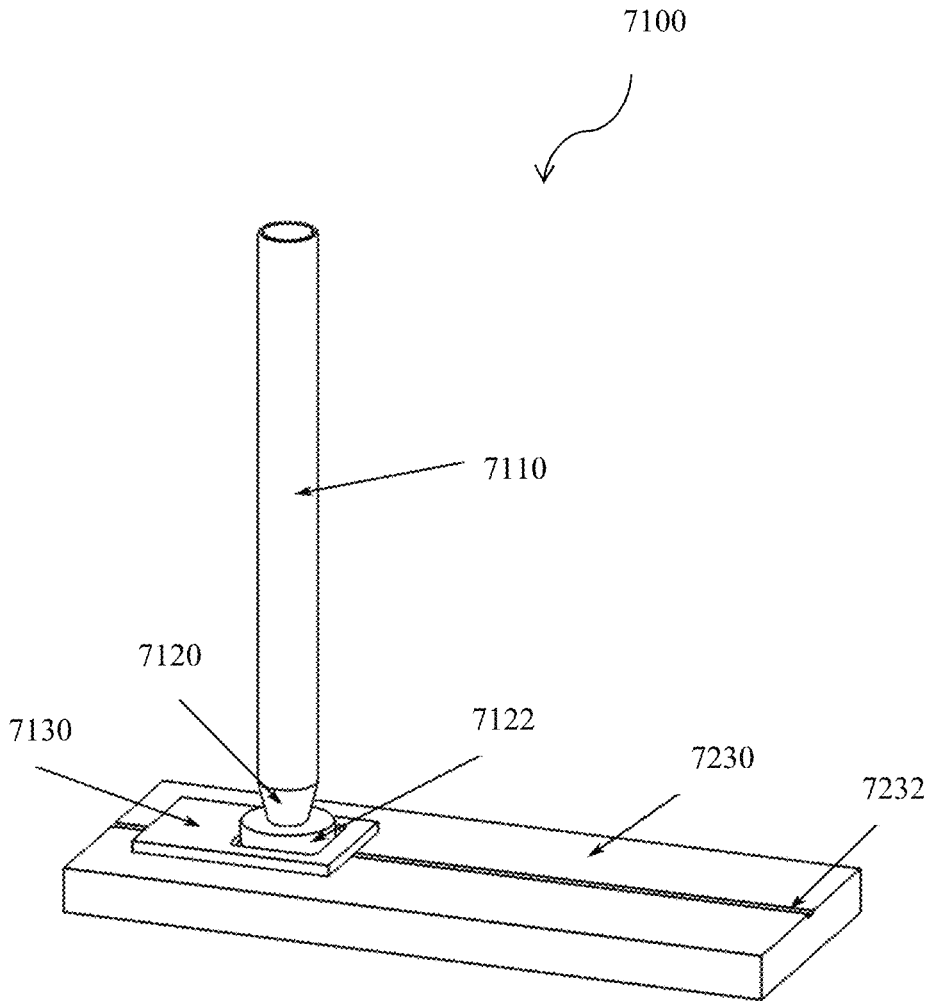
FIG. 10 provides a schematic illustrating another crucible/nozzle system in accordance with embodiments of the present disclosure.
Figure 11:
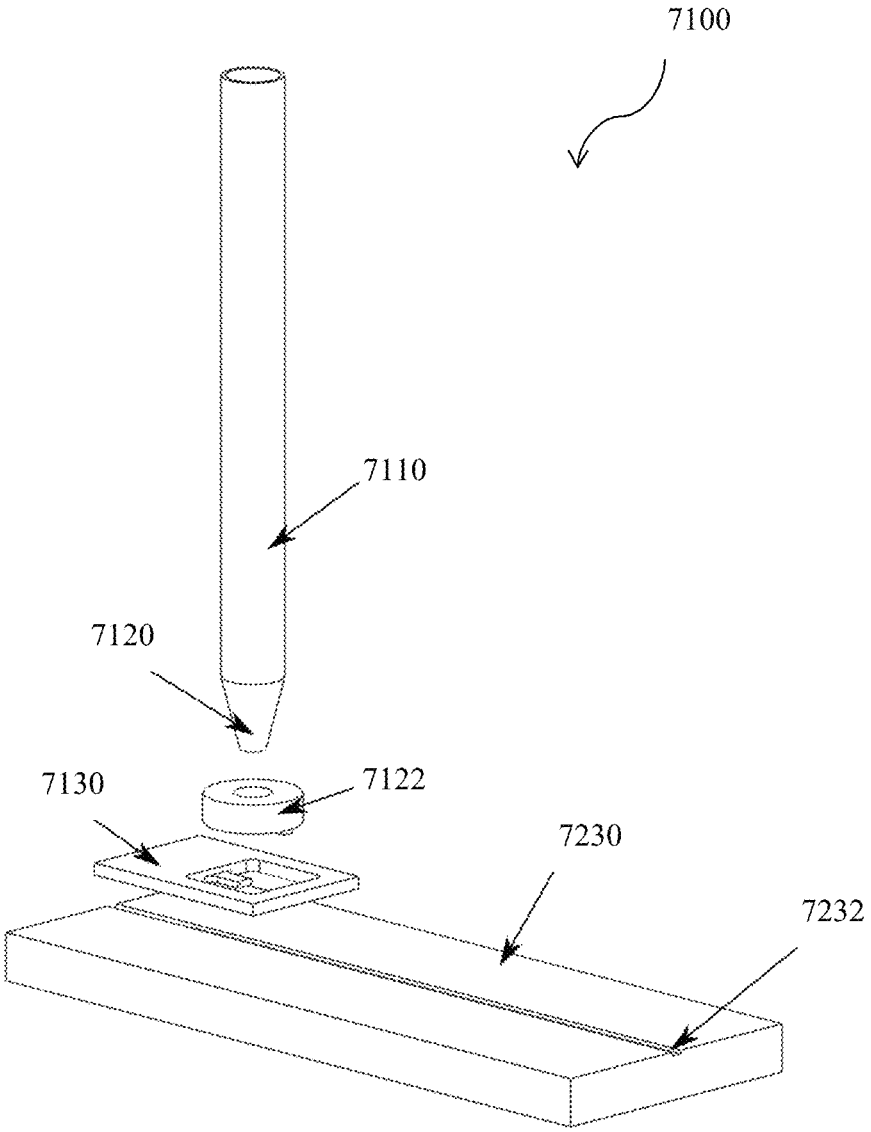
FIG. 11 provides an exploded view of the crucible/nozzle system of FIG. 10.

As shown in detail in FIG. 11, which is an exploded view of FIG. 10, the guide substrate 5130 is shaped so that it has minimal contact with the nozzle foot 5122, and therefore is not significantly heated by the nozzle foot 5122. By having minimal contact with the nozzle foot 5122, the guide substrate 130 may be held at a temperature considerably lower than the temperature of the nozzle 120. In some embodiments, the guide substrate may be held at temperatures at least 100° C. lower than the temperature at the nozzle. In other embodiments, the guide substrate may be held at temperatures at least 500° C. lower than the temperature at the nozzle.

In alternative embodiments of the crucible/nozzle system, the nozzle foot may be removably attached to the guide substrate. As illustrated in FIGS. 10 and 11, an exemplary embodiment of the crucible/nozzle system 7100 comprises the crucible 7110 in which the glass-forming alloy is melted, the orifice or nozzle 7120 through which the molten alloy is deposited, and the guide substrate 7130. The crucible/nozzle system 7100 is disposed so as to be above a chill substrate 7230 with a channel 7232 to enable the molten alloy to be extracted through nozzle 7120 and deposited into the channel 7232.

In this embodiment, as illustrated in detail in the exploded view in FIG. 11, the nozzle foot 7122 is removably attached to the guide substrate 7130. The nozzle foot 7122 is removably attached to the guide substrate by a hole formed in the guide substrate 7130 into which the nozzle foot 7122 is inserted.

Similarly to the previously described embodiments, the nozzle 7120 is shaped to extract and deposit the molten alloy in a controlled manner while allowing the molten alloy to be deposited evenly and continuously in the channel 7232 between the two substrates (guide substrate 7130 and chill substrate 7230). As shown schematically in FIGS. 10 and 11, the nozzle 7120 is integrally formed as the tapered base of the crucible 7110 and configured to allow for flow of molten alloy onto the chill substrate 7230.

In alternative embodiments, the guide substrate may be in contact with a thermal reservoir held at a temperature lower than the nozzle temperature. The thermal reservoir may be disposed between the guide substrate and the nozzle foot. In some embodiments, the thermal reservoir may be a thick copper substrate held at room temperature, over a contact area that is considerably larger (i.e. at least 100 times larger, and in some embodiments 1000 times larger) than the contact area between the guide substrate and the nozzle foot. In another embodiment, the guide substrate is water cooled. In yet another embodiment, a thermal insulator, such as a polymer or ceramic, is disposed at the interface between the guide substrate and the nozzle foot.

The Chill Substrate/Motion System:

The chill substrate/motion system 200 comprises the chill substrate 230, at least one actuator 210 and an actuator control system 220, as shown in FIG. 7. The molten alloy is deposited upon the chill substrate 230. The actuator (or actuators) 210 provides the differential motion between the chill substrate 230 and the nozzle/guide substrate 130. The actuator system 220 controls the actuator (or actuators) 210.

A variety of actuator types are suitable for use to provide the differential motion. In some embodiments, the actuators may be selected from, for example, electric, mechanical, pneumatic, and hydraulic. Electrical actuators may be selected from, for example, linear magnetic motors, stepper motors, and servomotors.

In the various embodiments, as shown schematically in FIGS. 7-12, the chill substrate 230, 5230 or 7230 comprise a groove to act as the channel 232, 5230 or 7230 into which the molten alloy is deposited.

Figure 12:
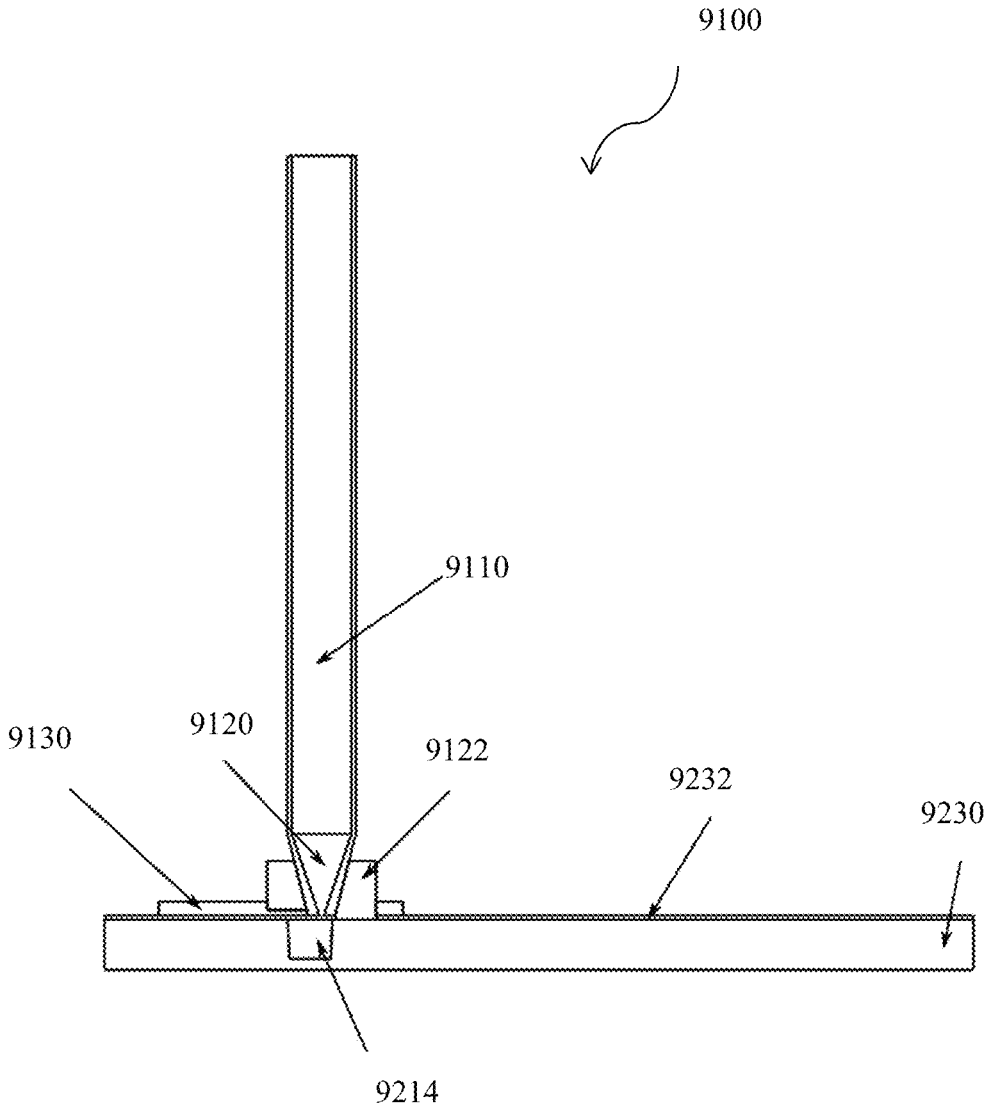
FIG. 12 provides a schematic illustrating a cross-sectional view of a crucible/nozzle system and chill substrate in accordance with embodiments of the present disclosure.

In another alternative embodiment, as shown schematically in FIG. 12, a chill substrate 9230 may have a "pre-flow" cavity 9234 so that the nozzle orifice can be pre-heated by the flow of the molten alloy without heating the chill substrate 9230 prior to the initiation of differential motion between the chill substrate 9230 and the nozzle 9120.

The Deposition Control System:

In some embodiments, the deposition control system controls the rate at which the molten alloy is extracted through the nozzle. The control of the melt flow through the nozzle orifice may be achieved by controlling the pressure. For example, the molten alloy may be extracted through the nozzle by applying a pressure $P_{app}$ to the molten alloy in the crucible that is greater than the ambient pressure in the channel $P_o$.

The pressure $P_{app}$ can be controlled by introducing an inert gas, such as argon of helium. In some embodiments, as shown schematically in FIG. 7, the deposition control system 300 may comprise a gas pressure/flow controller 310 and a pressure/gas control valve 320. The inert gas may be introduced into the apparatus through the pressure/gas control valve 320. As illustrated in FIG. 7, the gas pressure/flow controller 310 and the pressure/gas control valve 320 are disposed upstream of the crucible/nozzle system 100. In some embodiments, the pressure/gas control valve may be a one-way valve for introducing gas into the crucible/nozzle system to control the pressure $P_{app}$. In other embodiments, the pressure/gas control valve may be a check valve.

The pressure can also be controlled by controlling the differential pressure between the atmosphere inside the crucible and the atmosphere outside of the crucible by use of the gas pressure/flow controller 310 and the pressure/gas control valve 320. For example, the application of gas pressure is controlled by controlling the flow rate of the gas into the crucible through the gas pressure/flow controller 310.

In other embodiments, the flow of the molten alloy through the nozzle orifice may be controlled by applying mechanical pressure. In some embodiments the mechanical pressure can be controlled by applying a force, which can be applied by a pneumatic, hydraulic, or electrical actuator.

Environmental Chamber:

In some embodiments, as illustrated in FIG. 7, an apparatus 10 for producing a metallic glass by melt deposition may further include an environmental chamber 400 used for atmosphere control. In some embodiments, both the crucible/nozzle system 100 and the chill substrate/motion system 200 may be disposed inside the environmental chamber. In other embodiments, the crucible/nozzle system may be disposed inside the environmental chamber. In still other embodiments, the chill substrate/motion system may be disposed inside the environmental chamber. In yet other embodiments, the deposition control system 300 may also be disposed inside the environmental chamber.

The molten alloy may be extracted through the nozzle 120 by applying a pressure $P_{app}$ to the molten alloy in the crucible 110 that is greater than the ambient pressure in the channel $P_o$. The environmental chamber 400 may be used to maintain the ambient pressure, $P_o$, of the process and provide an atmosphere that is inert in the presence of the molten alloy. The environmental chamber 400 may be a vacuum chamber. As illustrated in FIG. 7, in some embodiments, a vacuum pump 410 is configured to be in fluid communication with the environmental chamber 400. Valve 420 is disposed to be fluidly between the vacuum pump 410 and environmental chamber 400. Vacuum pump 410 can be used to control the differential pressure between the atmosphere inside the crucible 110 and the atmosphere in channel such that the pressure in the channel $P_o$ is less than the pressure $P_{app}$ in the crucible 110.

In some embodiments, the environmental chamber 400 may be a vacuum chamber so that the inert gas pressure, $P_o$, can range between vacuum (typically 0.1 Pa) and 1 atmosphere. In other embodiments, the environmental chamber 400 may be a vacuum/pressure chamber so that the inert gas pressure, $P_o$, can range between a vacuum and pressures larger than 1 atmosphere. In some embodiments, the chamber frame comprises a metal such as steel or aluminum. In other embodiments, the chamber may include a window made of a transparent material, such as plexiglass, to enable visualization of the process. In yet other embodiments, the chamber includes a glove box to enable access to the apparatus without the need for evacuating the chamber.

Figure 13:
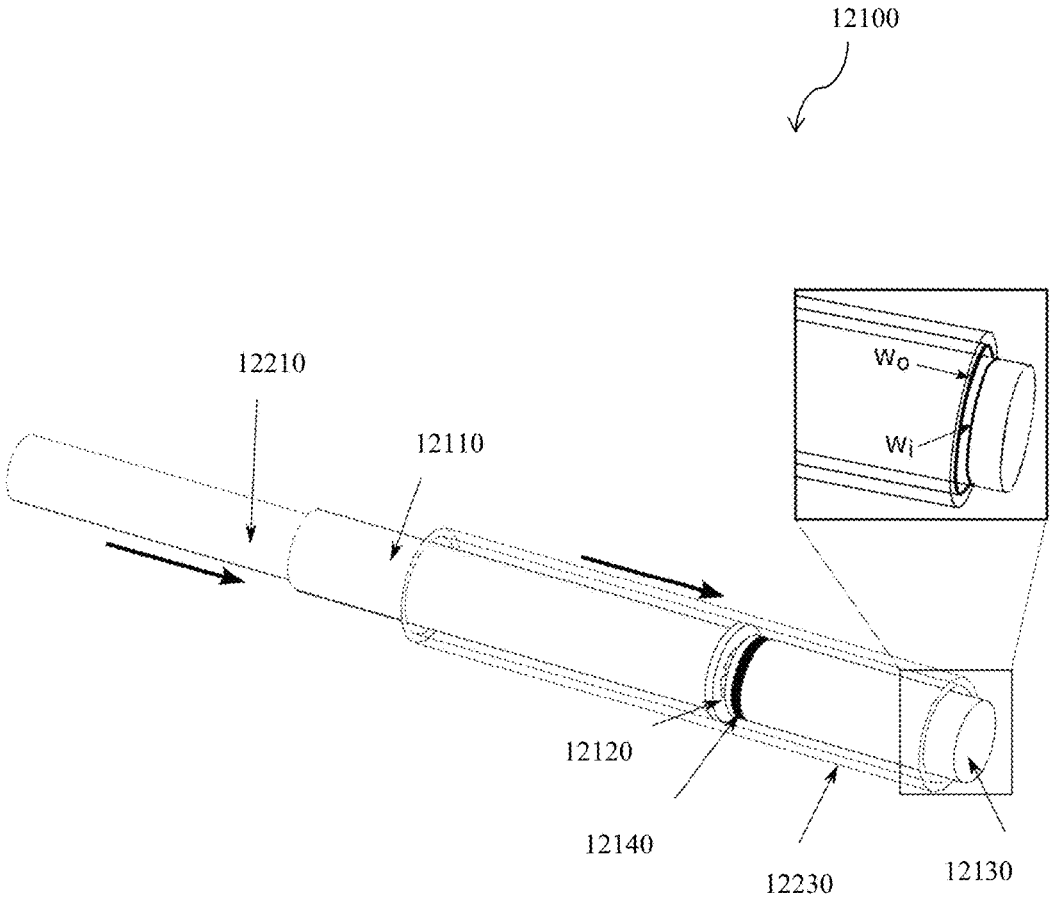
FIG. 13 provides a schematic illustrating an isometric view of an apparatus in accordance with embodiments of the present disclosure.
Figure 14:
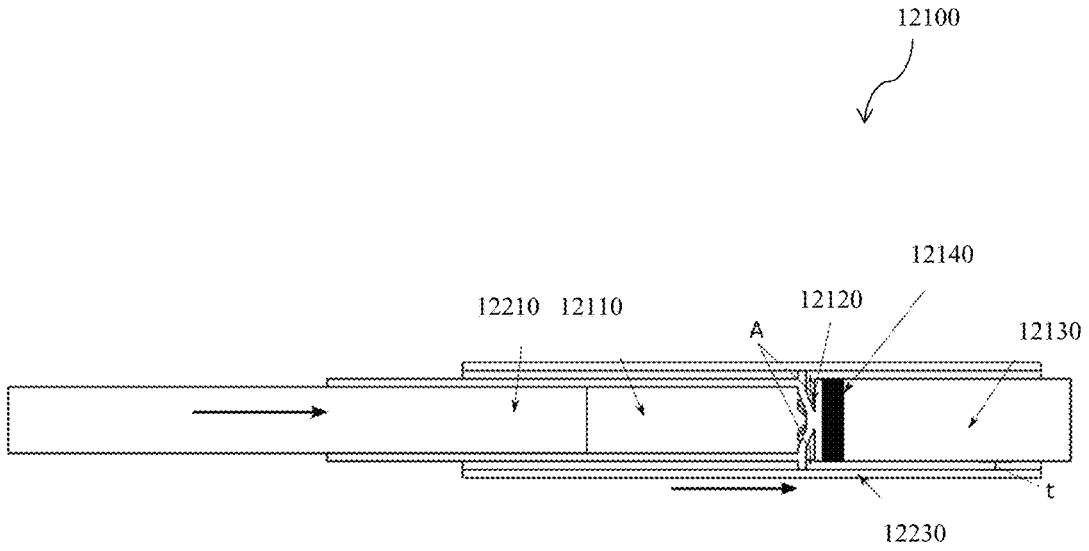
FIG. 14 provides a schematic illustrating a cross-sectional view of the apparatus of FIG. 13.

In another embodiment, as depicted in FIGS. 3, and 13 to 15, a metallic glass tube may be formed using an apparatus using tubular-shaped substrates. As illustrated in FIGS. 13 and 14, in some such embodiments a cylindrical chill tube 12230 of internal circumference $w_o$ acting as the exterior substrate moves concentrically over a stationary guide tube 12230 of exterior circumference $w_i$ acting as the interior substrate at velocity V such that a cylindrical tube-shape gap with thickness t is formed. In such embodiments the guide tube may be attached to a nozzle 12120 coupled to a melt reservoir 12110. The guide tube 12230 is held at a temperature lower than the temperature of the melt reservoir and nozzle. In some embodiments, the guide tube 12230 may be thermally isolated from the melt reservoir 12110 and nozzle 12120 by means of a thermal insulator 12140. In some embodiments, the melt reservoir 12110 has a cylindrical tube shape that is concentrically placed within the chill tube 12230. Likewise, in some such embodiments, the nozzle 12120 has a cylindrical shape configured to radially inject the molten alloy in the melt reservoir 12110 outwards from the guide tube towards the inner surface of the chill tube, as shown by arrows A. During operation, the nozzle 12120 is placed between the guide tube and the melt reservoir. In some embodiments, as depicted in the detailed view of FIG. 15, the guide tube may also comprise a lip 1230*a* along the outer edge of the nozzle on the side of motion having width w and height t.

The molten alloy may be extracted through the nozzle by applying a pressure $P_{app}$ by a plunger 12170 to the molten alloy in the reservoir that is greater than the ambient pressure in the gap $P_o$ such that the molten alloy is injected through the nozzle with a net positive pressure $P_{app}-P_o$ and at a flow rate or deposition rate Q.

In an alternative embodiment, the guide tube is moving while the chill tube is stationary, and in still other embodiments both the guide tube and chill tube are moving relative to each other.

Figure 15:
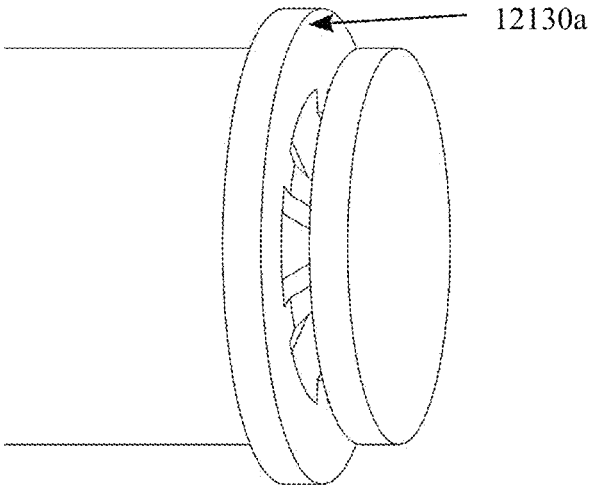
FIG. 15 proves a schematic illustrating an isometric view of the nozzle in the apparatus of FIG. 13.

Although the exemplary apparatus depicted in FIGS. 13-15 presents a cylindrical tube, the cross-section may vary. It will be appreciated by those skilled in the art that the cross-section may be circular, elliptical, square, or any other shape, configuration or geometry.

In some embodiments, the melt reservoir may be designed to undergo vibrational agitation. In certain embodiments the vibrational agitation is normal to the chill substrate, while in other embodiments is parallel to the chill substrate. Vibrational agitation may be used to overcome capillary effects which can lead to the break-up of the melt front. Likewise, vibrational agitation may help the molten alloy to contact the chill substrate and any "edges" in a mold cavity within the chill substrate. Vibrational agitation may also be useful in obtaining a high quality product sheet with precise edges or a tube.

It should be understood that the disclosed process can be achieved by any suitable deposition mechanism. In some embodiments, the molten alloy is deposited by applying a pressure to the molten alloy in a melt reservoir. In some embodiments, the pressure is pneumatic, i.e. is applied by gas pressure. In other embodiment, the pressure is mechanical, i.e. is applied by a plunger driven by a hydraulic or magnetic drive. The applied pressure is greater than the pressure in the gap or channel between the two substrates. In this embodiment, a net force would be exerted by the molten alloy against the substrates such that the molten alloy surface would be in continuous contact with the substrates to facilitate heat transfer from the molten alloy to the substrate (s) to quench the molten alloy, and to ensure good surface characteristics of the sheet or tube (where substrate features with length scales of 10 micrometers or less are replicated).

EXAMPLES

The following examples illustrate various aspects of the disclosure. It will be apparent to those skilled in the art that many modifications, both to materials and methods, may be practiced without departing from the scope of the disclosure.

Example 1

The materials used for the substrates can also affect the disclosed process. In particular, the thermal diffusivity of the substrates in comparison to the metallic glass may influence the velocity V and deposition rate Q for a given thickness.

For example, in some embodiments, the two substrates may have a thermal diffusivity much higher than the metallic glass (e.g. in some embodiments by at least a factor of 5, while in other embodiments by at least a factor of 10), such that their thermal diffusivity can be assumed to be approximately infinite. For example, copper has thermal diffusivity of about $1\times10^{-4}$ $m^2/s$, and can be considered approximately infinite when compared to the thermal diffusivity of the metallic glass, which is typically on the order of $1\times10^{-6}$ $m^2/s$. When both substrates have approximately infinite thermal diffusivity, the thermal relaxation time $\tau_{th}$ is determined by the equation:

$$\tau_{th}=t^2/\alpha \quad \text{Eq. (3)}$$

where $\alpha$ is the thermal diffusivity of the molten alloy. Therefore, according to Eqs. (2) and (3), the velocity V can be obtained as:

$$V=\alpha/t \quad \text{Eq. (4)}$$

and according to Eqs. (1) and (4), the deposition rate Q is obtained as:

$$Q=\alpha\cdot w \quad \text{Eq. (5)}$$

The thickness t can hence be chosen such that the thermal relaxation time does not exceed the minimum time required for the molten alloy to crystallize in the undercooled state according to Eq. 6 below:

$$t<\sqrt{(\alpha\cdot\tau_{cr})} \quad \text{Eq. (6)}$$

The thermal diffusivities for the alloys capable of forming metallic glasses are on the order of $\alpha\approx1\times10^{-6}$ $m^2/s$. Considering an example metallic glass having $\tau_{cr}=1$ s, then t<1 mm according to Eq. (6). To produce a metallic glass sheet or tube with w=10 cm and t=1 mm, the values for V and Q would be V=1 mm/s, and $Q=1\times10^{-5}$ $m^3/s$, respectively, according to Eqs. (4) and (5).

One skilled in the art will recognize that other parameter values may be incorporated into the above analysis to determine appropriate process and apparatus operating conditions tailored to the needs of the particular application.

Example 2

In other embodiments, one of the two substrates has a thermal diffusivity much higher than the alloy, such that its thermal diffusivity can be assumed to be approximately infinite, while the other substrate has a thermal diffusivity much lower than the alloy (e.g. in some embodiments by at least a factor of 2, while in other embodiments by at least a factor of 5), such that its thermal diffusivity can be assumed to be approximately zero. For example, one of the two substrates may be made of copper, which is considered to have near-infinite thermal diffusivity compared to the alloy, while the other substrate may be made of a silicate glass that typically has thermal diffusivity on the order of $10^{-7}$ $m^2/s$, and can be considered to be approximately zero compared to the alloy. When one substrate has approximately infinite thermal diffusivity and the other substrate has approximately zero thermal diffusivity, the thermal relaxation time is determined by the equation:

$$\tau_{th}=4t^2/\alpha \quad \text{Eq. (7)}$$

where $\alpha$ is the thermal diffusivity of the molten alloy capable of forming metallic glass. Therefore, according to Eqs. (2) and (7), the velocity V between the two substrates can be obtained by the following equation:

$$V=2\alpha/t \quad \text{Eq. (8)}$$

and according to Eqs. (1) and (8) the deposition rate Q can be obtained as:

$$Q=2\alpha\cdot w \quad \text{Eq. (9)}$$

The thickness t can hence be chosen such that the thermal relaxation time does not exceed the minimum time required for the molten alloy to crystallize in the undercooled state according to Eq. 10 below:

$$t<0.5\sqrt{(\alpha\cdot\tau_{cr})} \quad \text{Eq. (10).}$$

Considering an example metallic glass with a thermal diffusivity on the order of $\alpha\approx1\times10^{-6}$ $m^2/s$ having $\tau_{cr}=1$ s, then t<0.5 mm according to Eq. (10). To produce a metallic glass sheet or tube with w=10 cm and t=0.5 mm, the values for V and Q would be V=4 mm/s, and $Q=2\times10^{-5}$ $m^3/s$ according to Eqs. (8) and (9) for the embodiment where one substrate has infinite thermal diffusivity and the other substrate has near-zero thermal diffusivity.

One skilled in the art will recognize that other parameter values may be incorporated into the above analysis to determine appropriate process and apparatus operating conditions tailored to the needs of the particular application.

Example 3

In another embodiment, the thermal diffusivity of the substrates is neither much higher than that of the molten alloy, nor much lower (i.e. neither infinite, nor zero). For example, this would be satisfied if both substrates have thermal diffusivities lower than copper but higher than silicate glasses, or on the order of the thermal diffusivity of the molten alloy. In this embodiment, the velocity V and deposition rate Q can be obtained by Eqs. (11) and (12) respectively:

$$\alpha/t<V<2\alpha/t \quad \text{Eq. (11)}$$

$$\alpha\cdot w<Q<2\alpha\cdot w \quad \text{Eq. (12)}$$

The thickness t can be obtained by Eq. (13) as follows:

$$t<0.75\sqrt{(\alpha\cdot\tau_{cr})} \quad \text{Eq. (13)}$$

Considering an example metallic glass with a thermal diffusivity on the order of $\alpha\approx1\times10^{-6}$ $m^2/s$ having $\tau_{cr}=1$ s, then t<0.75 mm according to Eq. (13) for the embodiment where the thermal diffusivity of the substrates is neither infinite nor zero. To produce a metallic glass sheet or tube with w=10 cm and 0.5 mm<t<1 mm, the values for V and Q would be 1.3 mm/s<V<2.6 mm/s and $0.75\times10^{-5}$ $m^3/s<Q<1.5\times10^{-5}$ $m^3/s$.

One skilled in the art will recognize that other parameter values may be incorporated into the above analysis to determine appropriate process and apparatus operating conditions tailored to the needs of the particular application.

Example 4

A method and an apparatus in accordance with embodiments of the disclosure were used to produce a metallic glass strip by melt deposition.

An apparatus according to the embodiment illustrated in FIG. 4 was used. The apparatus was enclosed within an environmental steel chamber. A quartz crucible was used, with the nozzle comprised of the tapered base of the quartz crucible. The nozzle had an orifice of about 1 mm. A graphite nozzle foot was used and disposed between the nozzle and guide substrate. Planar guide and chill substrates were used. The guide substrate and chill substrate were made of copper. A channel was formed as a groove in the chill substrate, having width w=3 mm and thickness t=0.5 mm. The apparatus as included a stepper motor to provide the differential motion between the chill substrate and the nozzle/guide substrate.

In the example, the alloy was heated in the crucible by an induction coil. The molten alloy was extracted through the nozzle by applying gas (argon) pressure inside the crucible. The application of gas pressure was controlled by controlling the differential pressure between the atmosphere inside the crucible and the atmosphere outside of the crucible.

Figure 16:
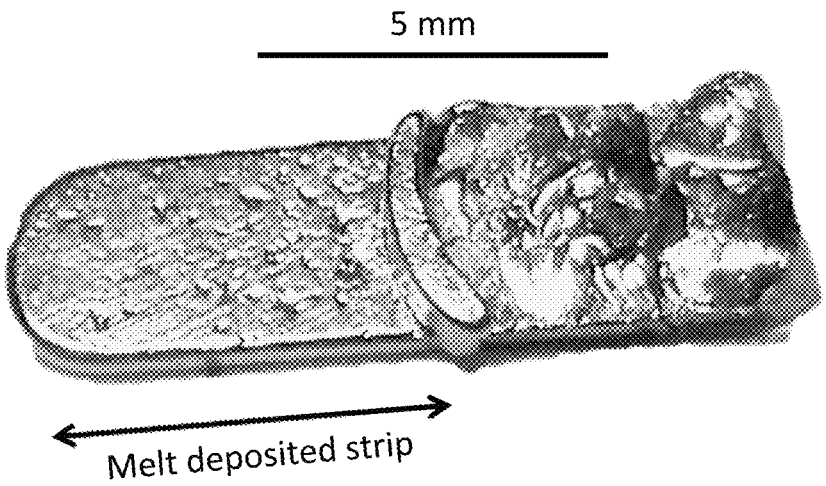
FIG. 16 provides a photograph of a metallic glass strip produced by melt deposition in accordance with embodiments of the present disclosure.
Figure 17:
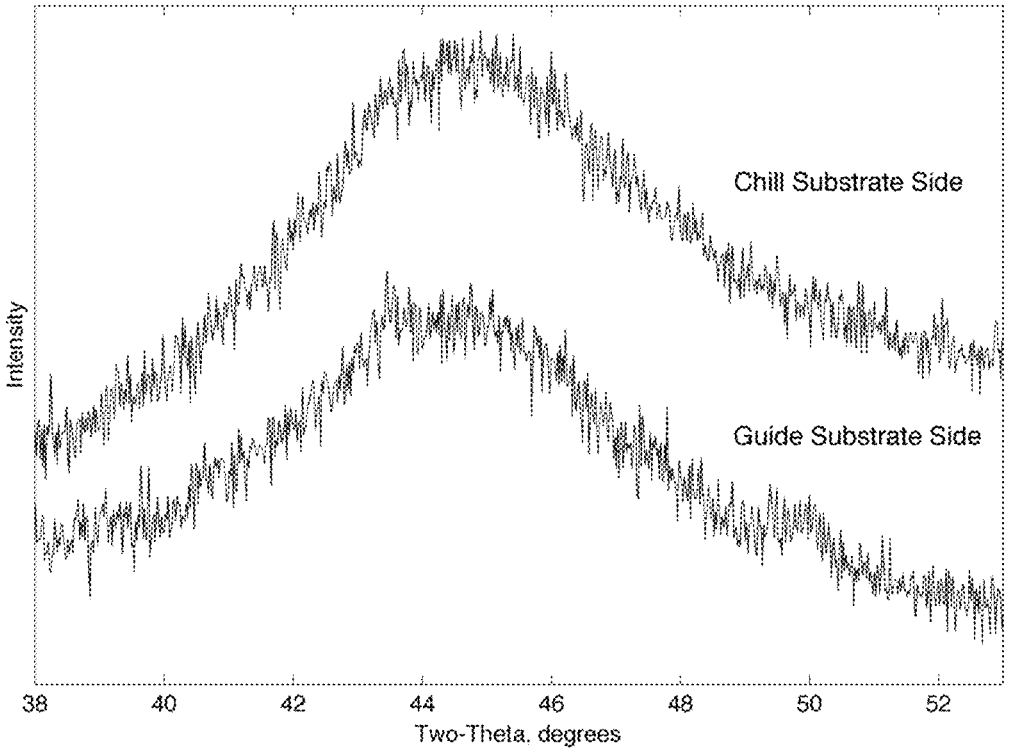
FIG. 17 provides x-ray diffractograms verifying the amorphous structure of the metallic glass strip of FIG. 15.

In a specific experiment, a metallic glass-forming alloy having composition $Ni_{71.4}Cr_{5.52}Nb_{3.38}P_{16.67}B_{3.03}$ was used. The chamber was evacuated to a pressure of about 1 Pa prior to backfilling with argon to a pressure of 1 atm. The molten alloy was heated to about 900° C., and extracted from the nozzle by applying a differential argon gas pressure of about 10 kPa. The relative velocity V between the chill substrate and the nozzle/guide substrate was 5 mm/s. A 5-mm long metallic glass strip having thickness t=0.5 mm and width w=3 mm was produced. A photograph of the strip is presented in FIG. 16. X-ray diffractograms verifying the amorphous structure of the strip are presented in FIG. 17.

The methods and apparatus herein can be valuable in the fabrication of electronic devices using bulk metallic glass objects. In various embodiments, the metallic glass may be used as housings or other parts of an electronic device, such as, for example, a part of the housing or casing of the device. Devices can include any consumer electronic device, such as mobile phones, desktop computers, laptop computers, and/or portable music players. The device can be a part of a display, such as a digital display, a monitor, an electronic-book reader, a portable web-browser, and a computer monitor. The device can also be an entertainment device, including a portable DVD player, DVD player, Blue-Ray disk player, video game console, music player, such as a portable music player. The device can also be a part of a device that provides control, such as controlling the streaming of images, videos, sounds, or it can be a remote control for an electronic device. The alloys can be part of a computer or its accessories, such as the hard driver tower housing or casing, laptop housing, laptop keyboard, laptop track pad, desktop keyboard, mouse, and speaker. The metallic glass can also be applied to a device such as a watch or a clock.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the present disclosure. Accordingly, the above description should not be taken as limiting the scope of the disclosure.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A method of forming a metallic glass object, the method comprising:

heating an alloy capable of forming a metallic glass to form a molten alloy;

the temperature of a first substrate and a second substrate is below the nose temperature of the metallic glass, the first substrate and second substrate are configured to move relatively to each other at a velocity V;

depositing the molten alloy at a deposition rate Q in a gap of thickness t separating the first substrate and the second substrate along an overlapping cross section between the first substrate and the second substrate having width w that is perpendicular to a direction of V, wherein the deposition rate Q is within 20% of the product V*t*w; and cooling the molten alloy with at least one of the first substrate and the second substrate.

2. The method of claim 1, wherein the gap thickness t is less than $\sqrt{(\alpha \cdot \tau_{cr})}$, where $\alpha$ is the thermal diffusivity of the melt and $\Sigma_{cr}$ is the minimum crystallization time of the metallic glass alloy.

3. The method of claim 1, wherein the gap thickness t is less than the critical casting thickness of the metallic glass alloy.

4. The method of claim 1, wherein the velocity V is greater than $0.5\alpha/t$ and less than $3.5\alpha/t$, where $\alpha$ is the thermal diffusivity of the molten alloy.

5. The method of claim 1, wherein at least one substrate is held at a temperature lower than the glass transition temperature of the metallic glass.

6. The method of claim 1, wherein the temperature of the molten alloy prior to deposition is at least 20° C. higher than the liquidus temperature $T_L$.

7. The method of claim 1, wherein the temperature of the molten alloy between the substrates reaches a steady state.

8. The method of claim 1, wherein a shearing rate of the molten alloy between the substrates is less than ratio V/t.

9. The method of claim 1, wherein the object has a high aspect ratio with the smallest dimension t of the object equal to or less than 20% of any of the larger dimensions w of the object.

* * * * *